US012408707B2

(12) United States Patent
Kabirat

(10) Patent No.: US 12,408,707 B2
(45) Date of Patent: Sep. 9, 2025

(54) ELECTRONIC AEROSOL PROVISION SYSTEM

(71) Applicant: Nicoventures Trading Limited, London (GB)

(72) Inventor: Junior Kabirat, London (GB)

(73) Assignee: Nicoventures Trading Limited, London (GB)

( * ) Notice: Subject to any disclaimer, the term of this patent is extended or adjusted under 35 U.S.C. 154(b) by 486 days.

(21) Appl. No.: 17/756,505

(22) PCT Filed: Nov. 27, 2020

(86) PCT No.: PCT/EP2020/083783
§ 371 (c)(1),
(2) Date: May 26, 2022

(87) PCT Pub. No.: WO2021/105462
PCT Pub. Date: Jun. 3, 2021

(65) Prior Publication Data

US 2023/0000171 A1 Jan. 5, 2023

(30) Foreign Application Priority Data

Nov. 29, 2019 (GB) ..... 1917454

(51) Int. Cl.
*A24F 40/57* (2020.01)
*A24B 15/167* (2020.01)
(Continued)

(52) U.S. Cl.
CPC ..... *A24F 40/57* (2020.01); *A24B 15/167* (2016.11); *A24F 40/20* (2020.01); *A24F 40/485* (2020.01); *A24F 40/53* (2020.01); *A24F 40/60* (2020.01)

(58) Field of Classification Search
None
See application file for complete search history.

(56) References Cited

U.S. PATENT DOCUMENTS

2011/0104218 A1* 5/2011 Karles ..... B01J 13/22 424/463
2014/0301721 A1 10/2014 Ruscio et al.
(Continued)

FOREIGN PATENT DOCUMENTS

EP 2753203 A1 7/2014
JP 2018500940 A 1/2018
(Continued)

OTHER PUBLICATIONS

International Search Report and Written Opinion for Application No. PCT/EP2020/083783, mailed on Mar. 3, 2021, 11 pages.
(Continued)

*Primary Examiner* — Cynthia Szewczyk
(74) *Attorney, Agent, or Firm* — Merchant & Gould P.C.

(57) ABSTRACT

A method of reducing the quantity of a first constituent in aerosol generating material using an aerosol generating device configured to deliver inhalable aerosol to a user is disclosed. The method comprises performing a first aerosolization process on a portion of the aerosol generating material comprising the first constituent to generate an aerosol for user inhalation, and performing a second aerosolization process on at least the portion of the aerosol generating material until the at least the portion of the aerosol generating material is substantially free of the first constituent. Also provided is an aerosol provision device and an aerosol provision system.

18 Claims, 8 Drawing Sheets

(51) Int. Cl.

| | |
|---|---|
| ***A24F 40/20*** | (2020.01) |
| ***A24F 40/485*** | (2020.01) |
| ***A24F 40/53*** | (2020.01) |
| ***A24F 40/60*** | (2020.01) |

(56) References Cited

U.S. PATENT DOCUMENTS

| | | | | |
|---|---|---|---|---|
| 2015/0208727 | A1* | 7/2015 | Kuczaj | H05B 1/0244 219/494 |
| 2016/0262454 | A1 | 9/2016 | Sears et al. | |
| 2017/0173278 | A1 | 6/2017 | Buchberger | |
| 2018/0104214 | A1* | 4/2018 | Raichman | A61P 11/06 |
| 2018/0263290 | A1 | 9/2018 | Collett et al. | |

FOREIGN PATENT DOCUMENTS

| | | | |
|---|---|---|---|
| JP | 2018504127 | A | 2/2018 |
| JP | 2019519194 | A | 7/2019 |
| JP | 2019526232 | A | 9/2019 |
| JP | 2023505084 | A | 2/2023 |
| RU | 2097996 | C1 | 12/1997 |
| WO | WO-2014102091 | A1 | 7/2014 |
| WO | 2014140320 | A1 | 9/2014 |
| WO | WO-2015166219 | A1 | 11/2015 |
| WO | 2016120344 | A2 | 8/2016 |
| WO | 2018066088 | A1 | 4/2018 |
| WO | WO-2019005526 | A1 | 1/2019 |
| WO | 2019030172 | A1 | 2/2019 |
| WO | 2019161089 | A1 | 8/2019 |
| WO | WO-2019186667 | A1 | 10/2019 |

OTHER PUBLICATIONS

"Decision to Grant received for Japanese Patent Application No. 2022-531370, mailed on Dec. 12, 2023", 5 pages (2 pages of English Translation and 3 pages of Official Copy).

"International Preliminary Report on Patentability for PCT Patent Application No. PCT/EP2020/083783, mailed on Jun. 9, 2022", 8 pages.

"Office Action received for Russian Patent Application No. 2022113927, mailed on Mar. 26, 2024", 18 pages (9 pages of English Translation and 9 pages of Official Copy).

Notice of Reasons for Rejection, Japanese Patent Application No. 2024002349, mailed Jun. 17, 2025, 5 pages.

* cited by examiner

ELECTRONIC AEROSOL PROVISION SYSTEM

PRIORITY CLAIM

The present application is a National Phase entry of PCT Application No. PCT/EP2020/083783, filed Nov. 27, 2020, which claims priority to Great Britain Application No. 1917454.9, filed Nov. 29, 2019, each of which is hereby fully incorporated herein by reference.

TECHNICAL FIELD

The present disclosure relates to non-combustible aerosol provision systems.

BACKGROUND

Electronic aerosol provision systems such as electronic cigarettes (e-cigarettes) generally contain a reservoir of a source liquid containing a formulation, typically including nicotine, from which an aerosol is generated, e.g. through heat vaporization. An aerosol source for an aerosol provision system may thus comprise a heater having a heating element arranged to receive source liquid from the reservoir, for example through wicking/capillary action. While a user inhales on the device, electrical power is supplied to the heating element to vaporize source liquid in the vicinity of the heating element to generate an aerosol for inhalation by the user. Such devices are usually provided with one or more air inlet holes located away from a mouthpiece end of the system. When a user sucks on a mouthpiece connected to the mouthpiece end of the system, air is drawn in through the inlet holes and past the aerosol source. There is a flow path connecting between the aerosol source and an opening in the mouthpiece so that air drawn past the aerosol source continues along the flow path to the mouthpiece opening, carrying some of the aerosol from the aerosol source with it. The aerosol-carrying air exits the aerosol provision system through the mouthpiece opening for inhalation by the user.

Other aerosol provision devices generate aerosol from a solid material, such as tobacco or a tobacco derivative. Such devices operate in a broadly similar manner to the liquid-based systems described above, in that the solid tobacco material is heated to a vaporization temperature to generate an aerosol which is subsequently inhaled by a user.

A large number of aerosol provision systems are modular in that they include a reusable part and a consumable part, with the consumable part comprising or consisting of aerosol generating material. When such a consumable part is depleted of aerosol generating material in the sense of it not being able to generate satisfactory aerosol from the aerosol generating material, a user may typically dispose of the consumable part. However, trace amounts of certain constituents may be present in the consumable. In some instances, it may be necessary to dispose of the consumable part in specialist disposal locations to prevent certain constituents causing damage to the environment. This can be inconvenient to the user, particularly if the user is not always in the vicinity of a specialist disposal location.

Various approaches are described which seek to help address some of these issues.

SUMMARY

According to a first aspect of certain embodiments there is provided a method of reducing the quantity of a first constituent in aerosol generating material using an aerosol generating device configured to deliver inhalable aerosol to a user, the method comprising: performing a first aerosolization process on a portion of the aerosol generating material comprising the first constituent to generate an aerosol for user inhalation; and performing a second aerosolization process on at least the portion of the aerosol generating material until the at least the portion of the aerosol generating material is substantially free of the first constituent.

In some embodiments, the first constituent is nicotine.

In some embodiments, after performing the second aerosolization process on the at least the portion of the aerosol generating material until the at least the portion of the aerosol generating material is substantially free of the first constituent, the concentration of nicotine in the at least a portion of aerosol generating material is less than 0.05 mg/ml when dissolved in 100 ml of solvent.

In some embodiments, after performing a second aerosolization process on the at least the portion of the aerosol generating material until the at least the portion of the aerosol generating material is substantially free of the first constituent, the concentration of nicotine in the at least a portion of aerosol generating material is less than 0.02 mg/ml when dissolved in 100 ml of solvent.

In some embodiments, the aerosol generating material is an amorphous solid.

In some embodiments, the amorphous solid comprises 0.5-60 wt % of a gelling agent; 5-80 wt % of an aerosol generating agent; and 5-60 wt % of at least one active substance, such as nicotine, wherein these weights are calculated on a dry weight basis.

In some embodiments, performing a first aerosolization process on the portion of the aerosol generating material comprising the first constituent to generate an aerosol for user inhalation comprises aerosolizing the portion of the aerosol generating material for a first time period, and performing a second aerosolization process on the at least the portion of the aerosol generating material until the at least the portion of the aerosol generating material is substantially free of the first constituent comprises aerosolizing the at least the portion of the aerosol generating material for a second time period, wherein the second time period is greater than the first time period.

In some embodiments, the second time period is greater than one minute.

In some embodiments, wherein the first time period is no greater than 10 seconds.

In some embodiments, the first and second aerosolization processes are performed by heating.

In some embodiments, the temperature to which the aerosol generating material is heated is no greater than 350° C.

In some embodiments, heating the portion of the aerosol generating material comprising the first constituent to generate an aerosol for user inhalation comprises heating the portion of the aerosol generating material to a first maximum temperature, and heating the at least the portion of the aerosol generating material until the at least the portion of the aerosol generating material is substantially free of the first constituent comprises heating the at least the portion of the aerosol generating material to a second maximum temperature, wherein the second maximum temperature is greater than the first maximum temperature.

In some embodiments, heating the portion of the aerosol generating material comprising the first constituent to generate an aerosol for user inhalation comprises heating the portion of the aerosol generating material to a first maximum temperature, and heating the at least the portion of the aerosol generating material until the at least the portion of the aerosol generating material is substantially free of the first constituent comprises heating the at least the portion of the aerosol generating material to a second maximum temperature, wherein the second maximum temperature is substantially the same as the first maximum temperature.

In some embodiments, the control circuitry is configured to monitor an activation parameter for each of a plurality of portions of aerosol generating material, the activation parameter signifying one or a combination of: the number of discrete times the portion is heated; the cumulative heating time the portion is heated for; and a weighted cumulative heating time the portion is heated for based on the temperature the portion is heated to.

In some embodiments, the method comprises calculating a heating period for heating each of the plurality of portions of the aerosol generating material until the plurality of portions of the aerosol generating material are substantially free of the first constituent, wherein the calculation takes into account the monitored activation parameter.

In some embodiments the method further comprises providing an alert when performing the second aerosolization process on the at least the portion of the aerosol generating material until the at least the portion of the aerosol generating material is substantially free of the first constituent, wherein the alert signifies to a user not to inhale on the device.

In some embodiments the method further comprises blocking an air outlet on the device when performing the first aerosolization process on the at least the portion of the aerosol generating material until the at least the portion of the aerosol generating material is substantially free of the first constituent.

According to a second aspect of certain embodiments there is provided an aerosol generating device for use with an aerosol generating article comprising aerosol generating material, wherein the aerosol generating material comprises a first constituent, the device comprising: a aerosol generating component for performing an aerosolization process on a portion of the aerosol generating material; and control circuitry configured to activate the aerosol generating component, wherein the control circuitry is configured to: perform a first aerosolization process on the portion of the aerosol generating material comprising the first constituent to generate an aerosol for user inhalation; and perform a second aerosolization process on the portion of the aerosol generating material until the portion is substantially free of the first constituent.

In some embodiments the aerosol generating device further comprises an indicator configured to output an alert when the at least the portion of the aerosol generating material is aerosolized until the portion is substantially free of the first constituent, the alert signifying to a user not to inhale on the device.

In some embodiments the aerosol generating device further comprises an airflow obstructing member configured to block an air outlet on the device when the at least the portion of the aerosol generating material is aerosolized until the portion is substantially free of the first constituent.

According to a third aspect of certain embodiments there is provided an aerosol provision system, the aerosol provision system comprising the aerosol provision device of the second aspect of certain embodiments and an aerosol generating article comprising aerosol generating material having the first constituent.

In some embodiments the aerosol generating article comprises a plurality of portions of aerosol generating material, wherein at least one portion comprises the first constituent.

According to a fourth aspect of certain embodiments there is provided an aerosol generating device for use with an aerosol generating article comprising aerosol generating material, wherein the aerosol generating material comprises a first constituent, the device comprising: aerosolization means for performing an aerosolization process on a portion of the aerosol generating material; and control means configured to activate the aerosolization means, wherein the control means is configured to: perform a first aerosolization process on the portion of the aerosol generating material comprising the first constituent to generate an aerosol for user inhalation; and perform a second aerosolization process the portion of the aerosol generating material until the portion is substantially free of the first constituent.

It will be appreciated that features and aspects of the invention described above in relation to the first and other aspects of the invention are equally applicable to, and may be combined with, embodiments of the invention according to other aspects of the invention as appropriate, and not just in the specific combinations described above.

BRIEF DESCRIPTION OF THE DRAWINGS

Embodiments of the invention will now be described, by way of example only, with reference to the accompanying drawings, in which.

DETAILED DESCRIPTION

Figure 1:
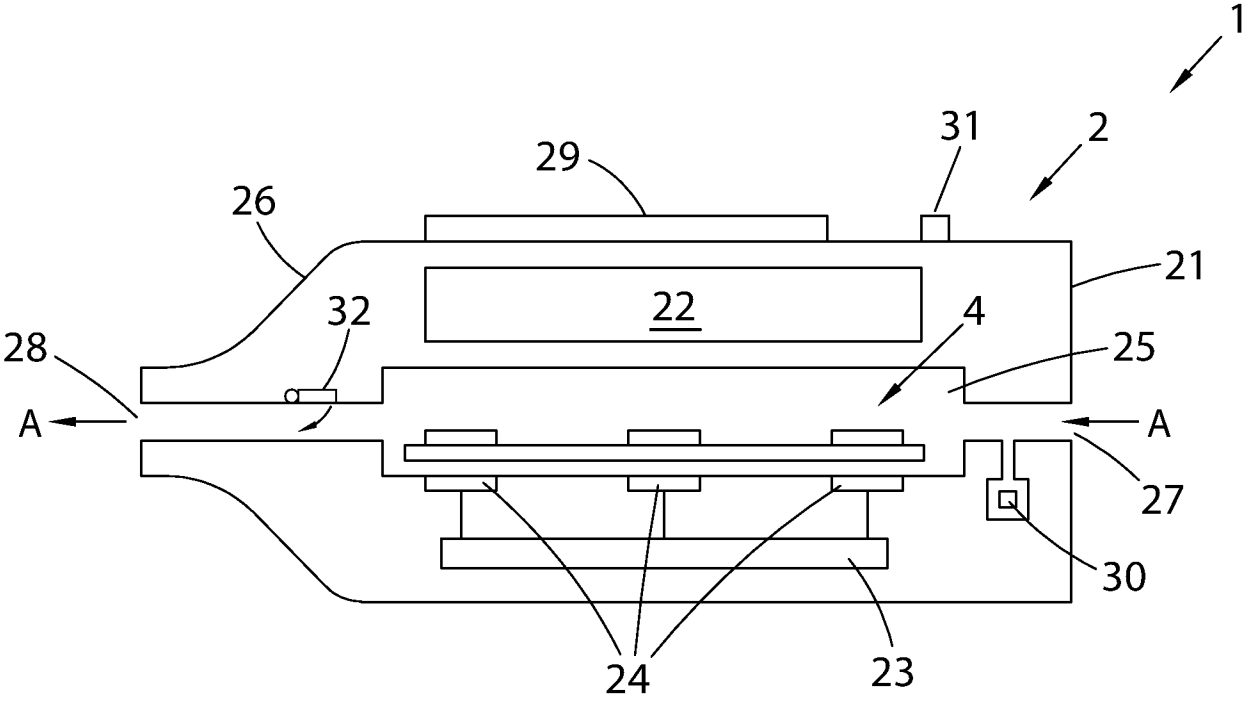
FIG. 1 is a cross-sectional view of a schematic representation of an aerosol provision system comprising an aerosol provision device and an aerosol provision article (e.g. an aerosol generating article), the device comprising a plurality of heating elements and the article comprising a plurality of portions of aerosol generating material.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of examples and embodiments discussed herein which are not described in detail may be implemented in accordance with any conventional techniques for implementing such aspects and features.

The present disclosure relates to a "non-combustible" aerosol provision system. A "non-combustible" aerosol provision system is one where a constituent aerosolizable material of the aerosol provision system (or component thereof) is not combusted or burned in order to facilitate delivery of an aerosol to a user. Furthermore, and as is common in the technical field, the terms "vapor" and "aerosol", and related terms such as "vaporize", "volatilize" and "aerosolize", may generally be used interchangeably.

In some implementations, the non-combustible aerosol provision system is an electronic cigarette, also known as a vaping device or electronic nicotine delivery system (END), although it is noted that the presence of nicotine in the aerosolizable material is not a requirement. Throughout the following description the terms "e-cigarette" or "electronic cigarette" are sometimes used but these terms may be used interchangeably with aerosol (vapor) provision system.

Typically, the non-combustible aerosol provision system may comprise a non-combustible aerosol provision device and an article (sometimes referred to as a consumable) for use with the non-combustible aerosol provision device. However, it is envisaged that articles which themselves comprise a means for powering an aerosol generating component may themselves form the non-combustible aerosol provision system.

The article, part or all of which, is intended to be consumed during use by a user. The article may comprise or consist of aerosolizable material (also referred to as an aerosol generating material). The article may comprise one or more other elements, such as a filter or an aerosol modifying substance (e.g. a component to add a flavor to, or otherwise alter the properties of, an aerosol that passes through or over the aerosol modifying substance).

Non-combustible aerosol provision systems often, though not always, comprise a modular assembly including both a reusable aerosol provision device and a replaceable article. In some implementations, the non-combustible aerosol provision device may comprise a power source and a controller (or control circuitry). The power source may, for example, be an electric power source, such as a battery or rechargeable battery. In some implementations, the non-combustible aerosol provision device may also comprise an aerosol generating component. However, in other implementations the article may comprise partially, or entirely, or consist of, the aerosol generating component.

In some implementations, the aerosol generating component is a heater capable of interacting with the aerosolizable material so as to release one or more volatiles from the aerosolizable material to form an aerosol. In some embodiments, the aerosol generating component is capable of generating an aerosol from the aerosolizable material without heating. For example, the aerosol generating component may be capable of generating an aerosol from the aerosolizable material without applying heat thereto, for example via one or more of vibrational, mechanical, pressurization or electrostatic means. The heater (or a heating element) may comprise one or more electrically resistive heaters, including for example one or more nichrome resistive heater(s) and/or one or more ceramic heater(s). The one or more heaters may comprise one or more induction heaters which includes an arrangement comprising one or more susceptors which may form a chamber into which an article comprising aerosolizable material is inserted or otherwise located in use. Alternatively or in addition, one or more susceptors may be provided in the aerosolizable material. Other heating arrangements may also be used.

The article for use with the non-combustible aerosol provision device generally comprises an aerosolizable material. Aerosolizable material, which also may be referred to herein as aerosol generating material, is material that is capable of generating aerosol, for example when heated, irradiated or energized in any other way. Aerosolizable material may, for example, be in the form of a solid, liquid or gel which may or may not contain nicotine and/or flavorants. In the following disclosure, the aerosolizable material is described as comprising an "amorphous solid", which may alternatively be referred to as a "monolithic solid" (i.e. non-fibrous). In some implementations, the amorphous solid may be a dried gel. The amorphous solid is a solid material that may retain some fluid, such as liquid, within it. In some implementations, the aerosolizable material may for example comprise from about 50 wt %, 60 wt % or 70 wt % of amorphous solid, to about 90 wt %, 95 wt % or 100 wt % of amorphous solid. However, it should be appreciated that principles of the present disclosure may be applied to other aerosolizable materials, such as tobacco, reconstituted tobacco, a liquid, such as an e-liquid, etc.

As appropriate, the aerosolizable material or amorphous solid may comprise any one or more of: an active constituent, a carrier constituent, a flavor, and one or more other functional constituents.

The active constituent as used herein may be a physiologically active material, which is a material intended to achieve or enhance a physiological response. The active constituent may for example be selected from nutraceuticals, nootropics, and psychoactives. The active constituent may be naturally occurring or synthetically obtained. The active constituent may comprise for example nicotine, caffeine, taurine, theine, vitamins such as B6 or B12 or C, melatonin, cannabinoids, or constituents, derivatives, or combinations thereof. The active constituent may comprise one or more constituents, derivatives or extracts of tobacco, *Cannabis* or another botanical. As noted herein, the active constituent may comprise one or more constituents, derivatives or extracts of *Cannabis*, such as one or more cannabinoids or terpenes.

In some embodiments, the active constituent comprises nicotine. In some embodiments, the active constituent comprises caffeine, melatonin or vitamin B12.

In some embodiments, the aerosol generating material comprises one or more cannabinoid compounds selected from the group consisting of: cannabidiol (CBD), tetrahydrocannabinol (THC), tetrahydrocannabinolic acid (THCA), cannabidiolic acid (CBDA), cannabinol (CBN), cannabigerol (CBG), cannabichromene (CBC), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM) and cannabielsoin (CBE), cannabicitran (CBT). The aerosol-generating material may comprise one or more cannabinoid compounds selected from the group consisting of cannabidiol (CBD) and THC (tetrahydrocannabinol). The aerosol-generating material may comprise cannabidiol (CBD). The aerosol-generating material may comprise nicotine and cannabidiol (CBD).

As noted herein, the active constituent may comprise or be derived from one or more botanicals or constituents, derivatives or extracts thereof. As used herein, the term "botanical" includes any material derived from plants including, but not limited to, extracts, leaves, bark, fibers, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Exemplary botanicals are tobacco, *Eucalyptus*, star anise, hemp, cocoa, *Cannabis*, fennel, lemongrass, peppermint, spearmint, rooibos, chamomile, flax, ginger, *Ginkgo biloba*, hazel, hibiscus, laurel, licorice (liquorice), matcha, mate, orange skin, *Papaya*, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, *Curcuma*, turmeric, sandalwood, cilantro, bergamot, orange blossom, myrtle, cassis, valerian, pimento, mace, damien, marjoram, olive, lemon balm, lemon basil, chive, *Carvi, Verbena*, tarragon, geranium, mulberry, *Ginseng*, theanine, theacrine, maca, ashwagandha, damiana, guarana, chlorophyll, baobab or any combination thereof. The mint may be chosen from the following mint varieties: *Mentha arventis, Mentha* c.v., *Mentha niliaca, Mentha piperita, Mentha piperita citrata* c.v., *Mentha piperita* c.v, *Mentha spicata crispa, Mentha cardifolia, Memtha longifolia, Mentha* suaveolens variegata, *Mentha pulegium, Mentha spicata* c.v. and *Mentha suaveolens*

In some embodiments, the active constituent comprises or is derived from one or more botanicals or constituents, derivatives or extracts thereof and the botanical is tobacco.

In some embodiments, the active constituent comprises or derived from one or more botanicals or constituents, derivatives or extracts thereof and the botanical is selected from *Eucalyptus*, star anise, cocoa and hemp.

In some embodiments, the active constituent comprises or derived from one or more botanicals or constituents, derivatives or extracts thereof and the botanical is selected from rooibos and fennel.

In some implementations, the aerosolizable material comprises a flavor (or flavorant).

As used herein, the terms "flavor" and "flavorant" refer to materials which, where local regulations permit, may be used to create a desired taste, aroma or other somatosensorial sensation in a product for adult consumers. They may include naturally occurring flavor materials, botanicals, extracts of botanicals, synthetically obtained materials, or combinations thereof (e.g., tobacco, *Cannabis*, licorice (liquorice), *Hydrangea*, eugenol, Japanese white bark *Magnolia* leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, *Papaya*, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, *Khat*, naswar, *Betel*, shisha, pine, honey essence, rose oil, vanilla, lemon oil, orange oil, orange blossom, cherry blossom, *Cassia*, caraway, cognac, jasmine, ylang-ylang, sage, fennel, wasabi, piment, ginger, coriander, coffee, hemp, a mint oil from any species of the genus *Mentha, Eucalyptus*, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, *Curcuma*, cilantro, myrtle, cassis, valerian, pimento, mace, damien, marjoram, olive, lemon balm, lemon basil, chive, *Carvi, Verbena*, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some embodiments, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor comprises flavor components extracted from *Cannabis*.

In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucolyptol, WS-3.

The carrier constituent may comprise one or more constituents capable of forming an aerosol (e.g., an aerosol former). In some embodiments, the carrier constituent may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate. The aerosol-generating material or amorphous solid may comprise an aerosol former. In some embodiments, the aerosol former comprises one or more polyhydric alcohols, such as propylene glycol, triethylene glycol, 1,3-butanediol and glycerin; esters of polyhydric alcohols, such as glycerol mono-, di- or triacetate; and/or aliphatic esters of mono-, di- or polycarboxylic acids, such as dimethyl dodecanedioate and dimethyl tetradecanedioate.

The one or more other functional constituents may comprise one or more of pH regulators, coloring agents, preservatives, binders, fillers, stabilizers, and/or antioxidants.

The aerosolizable material may be present on or in a carrier support (or carrier component) to form a substrate. The carrier support may, for example, be or comprise paper, card, paperboard, cardboard, reconstituted aerosolizable material, a plastics material, a ceramic material, a composite material, glass, a metal, or a metal alloy.

In some implementations, the article for use with the non-combustible aerosol provision device may comprise aerosolizable material or an area for receiving aerosolizable material. In some implementations, the article for use with the non-combustible aerosol provision device may comprise a mouthpiece, or alternatively the non-combustible aerosol provision device may comprise a mouthpiece which communicates with the article. The area for receiving aerosolizable material may be a storage area for storing aerosolizable material. For example, the storage area may be a reservoir.

FIG. 1 is a cross-sectional view through a schematic representation of an aerosol provision system 1 in accordance with certain embodiments of the disclosure. The aerosol provision system 1 comprises two main components, namely an aerosol provision device 2 and an aerosol provision article 4 (also referred to as an aerosol generating article).

The aerosol provision device 2 comprises an outer housing 21, a power source 22, control circuitry 23, a plurality of aerosol generating components 24, a receptacle 25, an inhalation or mouthpiece end 26, an air inlet 27, an air outlet 28, a touch-sensitive panel 29, an inhalation sensor 30, an indicator, e.g., an end of use indicator 31 and flow restriction member 32.

The outer housing 21 may be formed from any suitable material, for example a plastics material. The outer housing 21 is arranged such that the power source 22, control circuitry 23, aerosol generating components 24, receptacle 25 and inhalation sensor 30 are located within the outer housing 21. The outer housing 21 also defines the air inlet 27 and air outlet 28, described in more detail below. The touch sensitive panel 29 and end of use indicator are located on the exterior of the outer housing 21.

The outer housing 21 may further include an inhalation or mouthpiece end 26. The outer housing 21 and mouthpiece end 26 may be formed as a single component (that is, the mouthpiece end 26 may form a part of the outer housing 21). The inhalation or mouthpiece end 26 is defined as a region of the outer housing 21 which includes the air outlet 28 and may be shaped in such a way that a user may comfortably place their lips around the mouthpiece end 26 to engage with air outlet 28. In FIG. 1, the thickness of the outer housing 21 decreases towards the air outlet 28 to provide a relatively thinner portion of the aerosol provision device 2 which may be more easily accommodated by the lips of a user. In other implementations, however, the mouthpiece end 26 may be a removable component that is separate from, but able to be coupled to, the outer housing 21 and may be removed for cleaning and/or replacement with another mouthpiece end 26. The mouthpiece end 26 may, for example, be formed as part of the aerosol provision article 4.

The power source 22 is configured to provide operating power to the aerosol provision device 2. The power source 22 may be any suitable power source, such as a battery. For example, the power source 22 may comprise a rechargeable battery, such as a Lithium Ion battery. The power source 22 may be removable or form an integrated part of the aerosol provision device 2. In some implementations, the power source 22 may be recharged through connection of the device 2 to an external power supply (such as mains power) through an associated connection port, such as a USB port (not shown) or via a suitable wireless receiver (not shown).

The control circuitry 23 is suitably configured/programmed to control the operation of the aerosol provision device to provide certain operating functions of aerosol provision device 2. The control circuitry 23 may be considered to logically comprise various sub-units/circuitry elements associated with different aspects of the operation of aerosol provision device 2. For example, the control circuitry 23 may comprise a logical sub-unit for controlling the recharging of the power source 22. Additionally, the control circuitry 23 may comprise a logical sub-unit for communication, e.g., to facilitate data transfer from or to the aerosol provision device 2. However, a primary function of the control circuitry 23 is to control the aerosolization of aerosol generating material, as described in more detail below. It will be appreciated the functionality of the control circuitry 23 can be provided in various different ways, for example using one or more suitably programmed programmable computer(s) and/or one or more suitably configured application-specific integrated circuit(s)/circuitry/chip(s)/chipset(s) configured to provide the desired functionality. The control circuitry 23 is connected to the power source 22 and receives power from the power source 22 and may be configured to distribute or control the power supply to other components of the aerosol provision device 2.

In the described implementation, the aerosol provision device 2 further comprises a receptacle 25 which is arranged to receive an aerosol provision article 4.

The aerosol provision article 4 comprises a carrier component 42 and aerosol generating material 44. The aerosol provision article 4 is shown in more detail in FIGS. 2A to 2C. FIG. 2A is a top-down view of the aerosol provision article 4, FIG. 2B is an end-on view along the width axis of the aerosol provision article 4, and FIG. 2C is a side-on view along the longitudinal (length) axis of the aerosol provision article 4.

The aerosol provision article 4 comprises a carrier component 42 which in this implementation is formed of card. The carrier component 42 forms the majority of the aerosol provision article 4, and acts as a base for the aerosol generating material 44 to be deposited on.

Figure 2B:
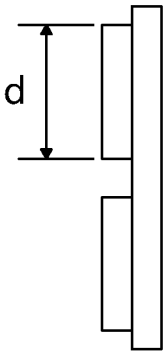
FIG. 2B is an end-on view along the longitudinal (length) axis of the aerosol generating article of FIG. 1.
Figure 2A:
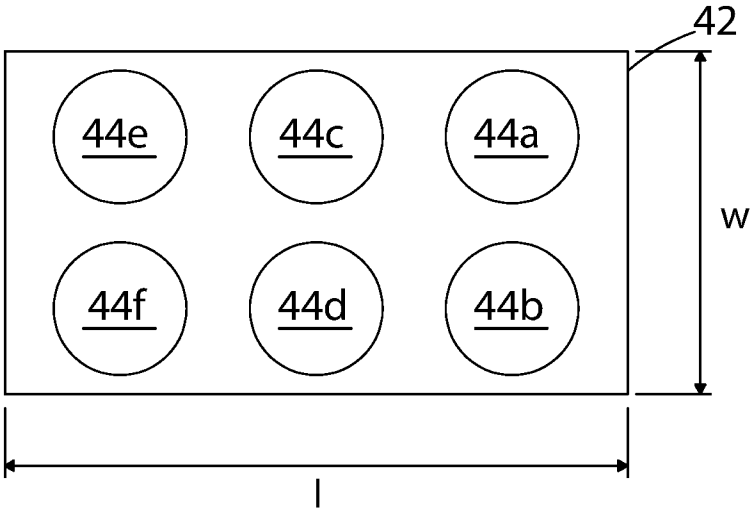
FIG. 2A is a top-down view of the aerosol provision article of FIG. 1.
Figure 2C:
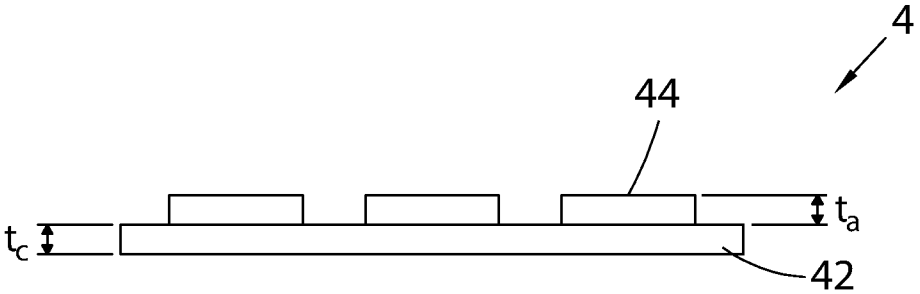
FIG. 2C is a side-on view along the width axis of the aerosol generating article of FIG. 1.

The carrier component 42 is broadly cuboidal in shape has a length 1, a width w and a thickness $t_c$ as shown in FIGS. 2A to 2C. By way of a concrete example, the length of the carrier component 42 may be 30 mm to 80 mm, the width may be 7 mm to 25 mm, and the thickness may be between 0.2 mm to 1 mm. However, it should be appreciated that the above are exemplary dimensions of the carrier component 42, and in other implementations the carrier component 42 may have different dimensions as appropriate. In some implementations, the carrier component 42 may comprise one or more protrusions extending in the length and/or width directions of the carrier component 42 to help facilitate handling of the aerosol provision article 4 by the user.

In the example shown in FIGS. 1 and 2, the aerosol provision article 4 comprises a plurality of discrete portions of aerosol generating material 44 disposed on a surface of the carrier component 42. More specifically, the article 4 comprises six discrete portions of aerosol generating material 44, labelled 44*a* to 44*f*, disposed in a two by three array. However, it should be appreciated that in other implementations a greater or lesser number of discrete portions may be provided, and/or the portions may be disposed in a different array (e.g., a one by six array). In the example shown, the aerosol generating material 44 is disposed at discrete, separate locations on a single surface of the carrier component 42. The discrete portions of aerosol generating material 44 are shown as having a circular footprint, although it should be appreciated that the discrete portions of aerosol generating material 44 may take any other footprint, such as square, triangular, hexagonal or rectangular, as appropriate. The discrete portions of aerosol generating material 44 have a diameter d and a thickness $t_a$ as shown in FIGS. 2A to 2C. The thickness $t_a$ may take any suitable value, for example the thickness $t_a$ may be in the range of 50 μm to 1.5 mm. In some embodiment, the thickness $t_a$ is from about 50 μm to about 200 μm, or about 50 μm to about 100 μm, or about 60 μm to about 90 μm, suitably about 77 μm. In other embodiments, the thickness $t_a$ may be greater than 200 μm, e.g., from about 50 μm to about 400 μm, or to about 1 mm, or to about 1.5 mm.

The discrete portions of aerosol generating material 44 are separate from one another such that each of the discrete portions may be energized (e.g., heated) individually/selectively to produce an aerosol. In some implementations, the portions of aerosol generating material 44 may have a mass no greater than 20 mg, such that the amount of material to be aerosolized by a given aerosol generating component 24 at any one time is relatively low. For example, the mass per portion may be equal to or lower than 20 mg, or equal to or lower than 10 mg, or equal to or lower than 5 mg. Of course, it should be appreciated that the total mass of the aerosol provision article 4 may be greater than 20 mg.

In the described implementation, the aerosol generating material 44 is an amorphous solid. Generally, the aerosol generating material 44 or amorphous solid may comprise a gelling agent (sometimes referred to as a binder) and an aerosol generating agent (which might comprise glycerol, for example). The gelling agent may comprise one or more compounds selected from cellulosic gelling agents, non-cellulosic gelling agents, guar gum, acacia gum and mixtures thereof. In some embodiments, the cellulosic gelling agent is selected from the group consisting of: hydroxymethyl cellulose, hydroxyethyl cellulose, hydroxypropyl cellulose, carboxymethylcellulose (CMC), hydroxypropyl methylcellulose (HPMC), methyl cellulose, ethyl cellulose, cellulose acetate (CA), cellulose acetate butyrate (CAB), cellulose acetate propionate (CAP) and combinations thereof. In some embodiments, the gelling agent comprises (or is) one or more of hydroxyethyl cellulose, hydroxypropyl cellulose, hydroxypropyl methylcellulose (HPMC), carboxymethylcellulose, guar gum, or acacia gum. In some embodiments, the gelling agent comprises (or is) one or more non-cellulosic gelling agents, including, but not limited to, agar, xanthan gum, gum Arabic, guar gum, locust bean gum, pectin, carrageenan, starch, alginate, and combinations thereof. In preferred embodiments, the non-cellulose based gelling agent is alginate or agar.

The gelling agent may further comprise a setting agent (e.g., a calcium source). In certain implementations, the setting agent comprises or consists of calcium acetate, calcium formate, calcium carbonate, calcium hydrogencarbonate, calcium chloride, calcium lactate, or a combination thereof. In certain implementations, the setting agent comprises or consists of calcium formate and/or calcium lactate. In particular examples, the setting agent comprises or consists of calcium formate. The inventors have identified that, typically, employing calcium formate as a setting agent results in an amorphous solid having a greater tensile strength and greater resistance to elongation.

The aerosol generating material 44 or amorphous solid may comprise one or more of the following: an active substance (which may include a tobacco extract), a flavorant, an acid, and a filler. Other components may also be present as desired. In certain embodiments, the aerosol-generating material 44 or amorphous solid comprises a gelling agent comprising a cellulosic gelling agent and/or a non-cellulosic gelling agent, an active substance and an acid.

The acid may be an organic acid. In some of these embodiments, the acid may be at least one of a monoprotic acid, a diprotic acid and a triprotic acid. In some such embodiments, the acid may contain at least one carboxyl functional group. In some such embodiments, the acid may be at least one of an alpha-hydroxy acid, carboxylic acid, dicarboxylic acid, tricarboxylic acid and keto acid. In some such embodiments, the acid may be an alpha-keto acid. In some such embodiments, the acid may be at least one of succinic acid, lactic acid, benzoic acid, citric acid, tartaric acid, fumaric acid, levulinic acid, acetic acid, malic acid, formic acid, sorbic acid, benzoic acid, propanoic and pyruvic acid. Suitably the acid is lactic acid. In other embodiments, the acid is benzoic acid. In other embodiments the acid may be an inorganic acid. In some of these embodiments the acid may be a mineral acid. In some such embodiments, the acid may be at least one of sulphuric acid, hydrochloric acid, boric acid and phosphoric acid. In some embodiments, the acid is levulinic acid. The inclusion of an acid is particularly preferred in embodiments in which the aerosol-generating material 44 comprises nicotine. In such embodiments, the presence of an acid may stabilise dissolved species in the slurry from which the aerosol-generating material 44 is formed. The presence of the acid may reduce or substantially prevent evaporation of nicotine during drying of the slurry, thereby reducing loss of nicotine during manufacturing. The amorphous solid may comprise a colorant. The addition of a colorant may alter the visual appearance of the amorphous solid. The presence of colorant in the amorphous solid may enhance the visual appearance of the amorphous solid and the aerosol-generating material 44. By adding a colorant to the amorphous solid, the amorphous solid may be color-matched to other components of the aerosol-generating material 44 or to other components of an article comprising the amorphous solid.

A variety of colorant may be used depending on the desired color of the amorphous solid. The color of amorphous solid may be, for example, white, green, red, purple, blue, brown or black. Other colors are also envisaged. Natural or synthetic colorants, such as natural or synthetic dyes, food-grade colorants and pharmaceutical-grade colorants may be used. In certain embodiments, the colorant is caramel, which may confer the amorphous solid with a brown appearance. In such embodiments, the color of the amorphous solid may be similar to the color of other components (such as tobacco material) in an aerosol-generating material 44 comprising the amorphous solid. In some embodiments, the addition of a colorant to the amorphous solid renders it visually indistinguishable from other components in the aerosol-generating material 44.

The colorant may be incorporated during the formation of the amorphous solid (e.g. when forming a slurry comprising the materials that form the amorphous solid) or it may be applied to the amorphous solid after its formation (e.g. by spraying it onto the amorphous solid).

An amorphous solid aerosolizable material offers some advantages over other types of aerosolizable materials commonly found in some electronic aerosol provision devices. For example, compared to electronic aerosol provision devices which aerosolize a liquid aerosolizable material, the potential for the amorphous solid to leak or otherwise flow from a location at which the amorphous solid is stored is greatly reduced. This means aerosol provision devices or articles may be more cheaply manufactured as the components do not necessarily require the same liquid-tight seals or the like to be used.

Compared to electronic aerosol provision devices which aerosolize a solid aerosolizable material, e.g., tobacco, a comparably lower mass of amorphous solid material can be aerosolized to generate an equivalent amount of aerosol (or to provide an equivalent amount of a constituent in the aerosol, e.g., nicotine). This is partially due to the fact that an amorphous solid can be tailored to not include unsuitable constituents that might be found in other solid aerosolizable materials (e.g., cellulosic material in tobacco, for example). For example, in some implementations, the mass per portion of amorphous solid is no greater than 20 mg, or no greater than 10 mg, or no greater than 5 mg. Accordingly, the aerosol provision device 2 can supply relatively less power to the aerosol provision article 4 and/or the aerosol provision article 4 can be comparably smaller to generate a similar aerosol, thus meaning the energy requirements for the aerosol provision device 2 may be reduced.

In some embodiments, the amorphous solid comprises tobacco extract. In these embodiments, the amorphous solid may have the following composition (by Dry Weight Basis, DWB): gelling agent (preferably comprising alginate) in an amount of from about 1 wt % to about 60 wt %, or about 10 wt % to 30 wt %, or about 15 wt % to about 25 wt %; tobacco extract in an amount of from about 10 wt % to about 60 wt %, or from about 40 wt % to 55 wt %, or from about 45 wt % to about 50 wt %; aerosol generating agent (preferably comprising glycerol) in an amount of from about 5 wt % to about 60 wt %, or from about 20 wt % to about 40 wt %, or from about 25 wt % to about 35 wt % (DWB). The tobacco extract may be from a single variety of tobacco or a blend of extracts from different varieties of tobacco. Such amorphous solids may be referred to as "tobacco amorphous solids", and may be designed to deliver a tobacco-like experience when aerosolized. In one embodiment, the amorphous solid comprises about 20 wt % alginate gelling agent, about 48 wt % Virginia tobacco extract and about 32 wt % glycerol (DWB).

The amorphous solid of these embodiments may have any suitable water content. For example, the amorphous solid may have a water content of from about 5 wt % to about 15 wt %, or from about 7 wt % to about 13 wt %, or about 10 wt %.

Suitably, in any of these embodiments, the amorphous solid has a thickness $t_a$ of from about 50 μm to about 200 μm, or about 50 μm to about 100 μm, or about 60 μm to about 90 μm, suitably about 77 μm.

In some implementations, the amorphous solid may comprise 0.5-60 wt % of a gelling agent; and 5-80 wt % of an aerosol generating agent (DWB). Such amorphous solids may contain no flavor, no acid and no active substance. Such amorphous solids may be referred to as "aerosol generating agent rich" or "aerosol generating agent amorphous solids". More generally, this is an example of an aerosol generating agent rich aerosol generating material 44 which, as the name suggests, is a portion of aerosol generating material 44 which is designed to deliver aerosol generating agent when aerosolized.

In these implementations, the amorphous solid may have the following composition (DWB): gelling agent in an amount of from about 5 wt % to about 40 wt %, or about 10 wt % to 30 wt %, or about 15 wt % to about 25 wt %; aerosol generating agent in an amount of from about 10 wt % to about 50 wt %, or from about 20 wt % to about 40 wt %, or from about 25 wt % to about 35 wt % (DWB).

In some other implementations, the amorphous solid may comprise 0.5-60 wt % of a gelling agent; 5-80 wt % of an aerosol generating agent; and 1-60 wt % of a flavor, (DWB). Such amorphous solids may contain flavor, but no active substance or acid. Such amorphous solids may be referred to as "flavorant rich" or "flavor amorphous solids". More generally, this is an example of a flavorant rich aerosol generating material which, as the name suggests, is a portion of aerosol generating material which is designed to deliver flavorant when aerosolized.

In these implementations, the amorphous solid may have the following composition (DWB): gelling agent in an amount of from about 5 wt % to about 40 wt %, or about 10 wt % to 30 wt %, or about 15 wt % to about 25 wt %; aerosol generating agent in an amount of from about 10 wt % to about 50 wt %, or from about 20 wt % to about 40 wt %, or from about 25 wt % to about 35 wt % (DWB), flavor in an amount of from about 30 wt % to about 60 wt %, or from about 40 wt % to 55 wt %, or from about 45 wt % to about 50 wt %.

In some other implementations, the amorphous solid may comprise 0.5-60 wt % of a gelling agent; 5-80 wt % of an aerosol generating agent; and 5-60 wt % of at least one active substance (DWB). Such amorphous solids may contain an active substance, but no flavor or acid. Such amorphous solids may be referred to as "active substance rich" or "active substance amorphous solids". For example, in one implementation, the active substance may be nicotine, and as such an amorphous solid as described above comprising nicotine may be referred to as a "nicotine amorphous solid". More generally, this is an example of an active substance rich aerosol generating material 44 which, as the name suggests, is a portion of aerosol generating material 44 which is designed to deliver an active substance when aerosolized.

In these implementations, amorphous solid may have the following composition (DWB): gelling agent in an amount of from about 5 wt % to about 40 wt %, or about 10 wt % to 30 wt %, or about 15 wt % to about 25 wt %; aerosol generating agent in an amount of from about 10 wt % to about 50 wt %, or from about 20 wt % to about 40 wt %, or from about 25 wt % to about 35 wt % (DWB), active substance in an amount of from about 30 wt % to about 60 wt %, or from about 40 wt % to 55 wt %, or from about 45 wt % to about 50 wt %.

In some other implementations, the amorphous solid may comprise 0.5-60 wt % of a gelling agent; 5-80 wt % of an aerosol generating agent; and 0.1-10 wt % of an acid (DWB). Such amorphous solids may contain acid, but no active substance and flavorant. Such amorphous solids may be referred to as "acid rich" or "acid amorphous solids". More generally, this is an example of an acid rich aerosol generating material which, as the name suggests, is a portion of aerosol generating material which is designed to deliver an acid when aerosolized.

In these implementations, the amorphous solid may have the following composition (DWB): gelling agent in an amount of from about 5 wt % to about 40 wt %, or about 10 wt % to 30 wt %, or about 15 wt % to about 25 wt %; aerosol generating agent in an amount of from about 10 wt % to about 50 wt %, or from about 20 wt % to about 40 wt %, or from about 25 wt % to about 35 wt % (DWB), acid in an amount of from about 0.1 wt % to about 8 wt %, or from about 0.5 wt % to 7 wt %, or from about 1 wt % to about 5 wt %, or form about 1 wt % to about 3 wt %.

The thickness of these amorphous solids may be greater than those described above, e.g., up to 2 mm, or up to 1.5 mm, in part because the user may select to repeatedly heat the portions to extract the desired aerosol from the portions.

The aerosol provision article 4 may comprise a plurality of portions of aerosol generating material 44 all formed form the same aerosol generating material (e.g., one of the amorphous solids described above). Alternatively, the article 4 may comprise a plurality of portions of aerosol generating material 44 where at least two portions are formed from different aerosol generating material (e.g., one of the amorphous solids described above).

The receptacle 25 is suitably sized to removably receive the aerosol provision article 4 therein. Although not shown, the aerosol provision device 2 may comprise a hinged door or removable part of the outer housing 21 to permit access to the receptacle 25 such that a user may insert and/or remove the aerosol provision article 4 from the receptacle 25. The hinged door or removable part of the outer housing 21 may also act to retain the aerosol provision article 4 within the receptacle 25 when closed. When the aerosol provision article 4 is exhausted or the user simply wishes to switch to a different aerosol provision article 4, the aerosol provision article 4 may be removed from the aerosol provision device 2 and a replacement aerosol provision article 4 positioned in the receptacle 25 in its place. Alternatively, the aerosol provision device 2 may include a permanent opening that communicates with the receptacle 25 and through which the aerosol provision article 4 can be inserted into the receptacle 25. In such implementations, a retaining mechanism for retaining the aerosol provision article 4 within the receptacle 25 of the aerosol provision device 2 may be provided.

As seen in FIG. 1, the device 2 comprises a number of aerosol generating components 24. In the described implementation, the aerosol generating components 24 are heating elements 24, and more specifically resistive heating elements 24. Resistive heating elements 24 receive an electrical current and convert the electrical energy into heat. The resistive heating elements 24 may be formed from, or comprise, any suitable resistive heating material, such as NiChrome (Ni20Cr80), which generates heat upon receiving an electrical current. In one implementation, the heating elements 24 may comprise an electrically insulating substrate on which resistive tracks are disposed.

Figure 3:
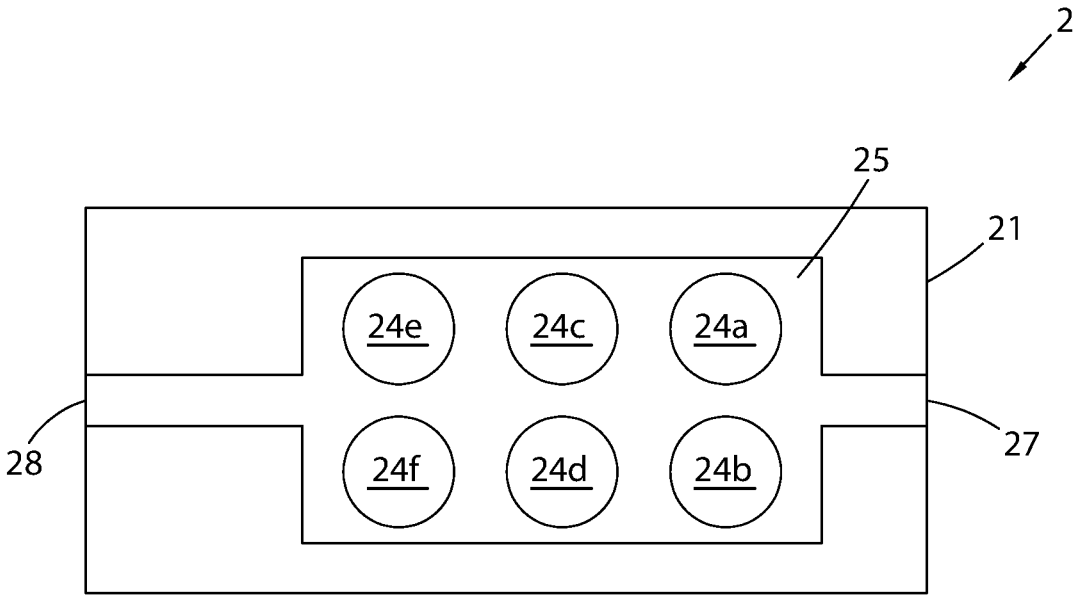
FIG. 3 is cross-sectional, top-down view of the heating elements of the aerosol provision device of FIG. 1.

FIG. 3 is a cross-sectional, top-down view of the aerosol provision device 2 showing the arrangement of the heating elements 24 in more detail. In FIGS. 1 and 3, the heating elements 24 are positioned such that a surface of a heating element 24 forms a part of the surface of the receptacle 25. That is, an outer surface of a heating element 24 is flush with the inner surface of the receptacle 25. More specifically, the outer surface of a heating element 24 that is flush with the inner surface of the receptacle 25 is a surface of the heating element 24 that is heated (i.e., its temperature increases) when an electrical current is passed through the heating element 24.

The heating elements 24 are arranged such that, when the aerosol provision article 4 is received in the receptacle 25, each heating element 24 aligns with a corresponding discrete portion of aerosol generating material 44. Hence, in this example, six heating elements 24 are arranged in a two by three array broadly corresponding to the arrangement of the two by three array of the six discrete portions of aerosol generating material 44 shown in FIG. 2A. However, as discussed above, the number of heating elements 24 may be different in different implementations, for example there may be 8, 10, 12, 14, etc. heating elements 24. In some implementations, the number of heating elements 24 is greater than or equal to six but no greater than 20.

More specifically, the heating elements 24 are labelled 24*a* to 24*f* in FIG. 3, and it should be appreciated that each heating element 24 is arranged to align with a corresponding portion of aerosol generating material 44 as denoted by the corresponding letter following the references 24/44. Accordingly, each of the heating elements 24 can be individually activated to heat a corresponding portion of aerosol generating material 44.

While the heating elements 24 are shown flush with the inner surface of the receptacle 25, in other implementations the heating elements 24 may protrude into the receptacle 25. In either case, the article 4 contacts the surfaces of the heating elements 24 when present in the receptacle 25 such that heat generated by the heating elements 24 is conducted to the aerosol generating material 44 through the carrier component 42.

In some implementations, to improve the heat-transfer efficiency, the receptacle may comprise components which apply a force to the surface of the carrier component 42 so as to press the carrier component 42 onto the heater elements 24, thereby increasing the efficiency of heat transfer via conduction to the aerosol generating material 44. Additionally or alternatively, the heater elements 24 may be configured to move in the direction towards/away from the aerosol provision article 4, and may be pressed into the surface of carrier component 42 that does not comprise the aerosol generating material 44.

In use, the aerosol provision device 2 (and more specifically the control circuitry 23) is configured to deliver power to the heating elements 24 in response to a user input. Broadly speaking, the control circuitry 23 is configured to selectively apply power to the heating elements 24 to subsequently heat the corresponding portions of aerosol generating material 44 to generate aerosol. When a user inhales on the aerosol provision device 2 (i.e., inhales at mouthpiece end 26), air is drawn into the aerosol provision device 2 through air inlet 27, into the receptacle 25 where it mixes with the aerosol generated by heating the aerosol generating material 44, and then to the user's mouth via air outlet 28. That is, the aerosol is delivered to the user through mouthpiece end 26 and air outlet 28.

The aerosol provision device 2 of FIG. 1 includes a touch-sensitive panel 29 and an inhalation sensor 30. Collectively, the touch-sensitive panel 29 and inhalation sensor 30 act as mechanisms for a receiving a user input to cause the generation of aerosol, and thus may more broadly be referred to as user input mechanisms. The received user input may be said to be indicative of a user's desire to generate an aerosol.

The touch-sensitive panel 29 may be a capacitive touch sensor and can be operated by a user of the aerosol provision device 2 placing their finger or another suitably conductive object (for example a stylus) on the touch-sensitive pane 291. In the described implementation, the touch-sensitive panel 29 includes a region which can be pressed by a user to start aerosol generation. The control circuitry 23 may be configured to receive signaling from the touch-sensitive panel 29 and to use this signaling to determine if a user is pressing (i.e. activating) the region of the touch-sensitive panel 29. If the control circuitry 23 receives this signaling, then the control circuitry 23 is configured to supply power from the power source 22 to one or more of the heating elements 24. Power may be supplied for a predetermined time period (for example, three seconds) from the moment a touch is detected, or in response to the length of time the touch is detected for. In other implementations, the touch sensitive panel 29 may be replaced by a user actuatable button (not shown) or the like.

The inhalation sensor 30 may be a pressure sensor or microphone or the like configured to detect a drop in pressure or a flow of air caused by the user inhaling on the aerosol provision device 2. The inhalation sensor 30 is located in fluid communication with the air flow pathway (that is, in fluid communication with the air flow path between air inlet 27 and air outlet 28). In a similar manner as described above, the control circuitry 23 may be configured to receive signaling from the inhalation sensor 30 and to use this signaling to determine if a user is inhaling on the aerosol provision system 1. If the control circuitry 23 receives this signaling, then the control circuitry 23 is configured to supply power from the power source 22 to one or more of the heating elements 24. Power may be supplied for a predetermined time period (for example, three seconds) from the moment inhalation is detected, or in response to the length of time the inhalation is detected for.

In the described example, both the touch-sensitive panel 29 and inhalation sensor 30 detect the user's desire to begin generating aerosol for inhalation. The control circuitry 23 may be configured to only supply power to the heating element 24 when signaling from both the touch-sensitive panel 29 and inhalation sensor 30 are detected. This may help prevent inadvertent activation of the heating elements 24 from accidental activation of one of the user input mechanisms. However, in other implementations, the aerosol provision system 1 may have only one of a touch sensitive panel 29 and an inhalation sensor 30.

These aspects of the operation of the aerosol provision system 1 (i.e. puff detection and touch detection) may in themselves be performed in accordance with established techniques (for example using conventional inhalation sensor and inhalation sensor signal processing techniques and using conventional touch sensor and touch sensor signal processing techniques).

In some implementations, in response to detecting the signaling from either one or both of the touch-sensitive panel 29 and inhalation sensor 30, the control circuitry 23 is configured to sequentially supply power to each of the individual heating elements 24.

More specifically, the control circuitry 23 is configured to sequentially supply power to each of the individual heating elements 23 in response to a sequence of detections of the signaling received from either one or both of the touch-sensitive panel 29 and inhalation sensor 30. For example, the control circuitry 23 may be configured to supply power to a first heating element 24 of the plurality of heating elements 24 when the signaling is first detected (e.g., from when the aerosol provision device 2 is first switched on). When the signaling stops, or in response to the predetermined time from the signaling being detected elapsing, the control circuitry 23 registers that the first heating element 24 has been activated (and thus the corresponding discrete portion of aerosol generating material 44 has been heated). The control circuitry 23 determines that in response to receiving subsequent signaling from either one or both of the touch-sensitive panel 29 and inhalation sensor 30 that a second heating element 24 is to be activated. Accordingly, when the signaling from either one or both of the touch-sensitive panel 29 and inhalation sensor 30 is received by the control circuitry 23, the control circuitry 23 activates the second heating element 24. This process is repeated for remaining heating elements 24, such that all heating elements 24 are sequentially activated.

Effectively, this operation means that for each inhalation a different one of the discrete portions of aerosol generating material 44 is heated and an aerosol generated therefrom. In other words, a single discrete portion of aerosol generating material 44 is heated per user inhalation.

In other implementations, the control circuitry 23 may be configured to activate the first heating element 24 a plurality of times (e.g., two) before determining that the second heating element 24 should be activated in response to subsequent signaling from either one or both of the touch-sensitive panel 29 and inhalation sensor 30, or to activate each of the plurality of heating elements 24 once and when all heating elements 24 have be activated once, detection of subsequent signaling causes the heating elements 24 to be sequentially activated a second time.

Such sequential activations may be dubbed "a sequential activation mode", which is primarily designed to deliver a consistent aerosol per inhalation (which may be measured in terms of total aerosol generated, or a total constituent delivered, for example). Hence, this mode may be most effective when each portion of the aerosol generating material 44 of the aerosol generating article 4 is substantially identical; that is, portions 44*a* to 44*f* are formed of the same material.

In some other implementations, in response to detecting the signaling from either one or both of the touch-sensitive panel 29 and inhalation sensor 30, the control circuitry 23 is configured to supply power to one or more of the heating elements 24 simultaneously.

In such implementations, the control circuitry 23 may be configured to supply power to selected ones of the heating elements 24 in response to a predetermined configuration. The predetermined configuration may be a configuration selected or determined by a user. For example, the touch-sensitive panel 29 may comprise a region that permits the user to individually select which of the heating elements 24 to activate when signaling from either one or both of the touch-sensitive panel 29 and inhalation sensor 30 is received by the control circuitry 23. In some implementations, the user may also be able to set the power level to be supplied to each heating element 24 in response to receiving the signaling.

Figure 4:
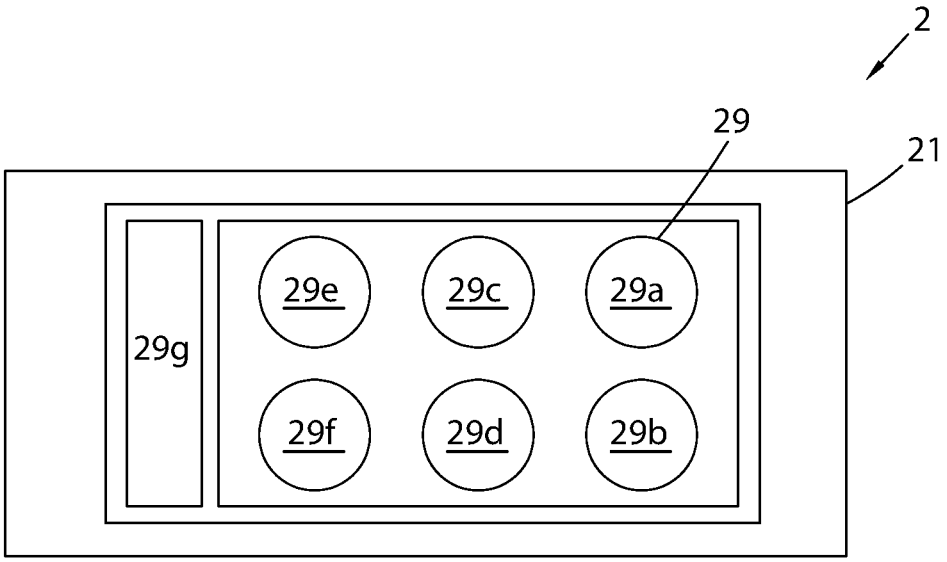
FIG. 4 is a top-down view of an exemplary touch sensitive panel for operating various functions of the aerosol provision system of FIG. 1.

FIG. 4 is a top-down view of the touch-sensitive panel 29 in accordance with such implementations. FIG. 4 schematically shows outer housing 21 and touch-sensitive panel 29 of aerosol provision device 2 as described previously. The touch-sensitive panel 29 comprises six regions 29*a* to 29*f* which correspond to each of the six heating elements 24, and a region 29*g* which corresponds to the region for indicating that a user wishes to start inhalation or generating aerosol as described previously. The six regions 29*a* to 29*f* each correspond to touch-sensitive regions which can be touched by a user to control the power delivery to each of the six corresponding heating elements 24. In the described implementation, each heating element 24 can have multiple states, e.g., an off state in which no power is supplied to the heating element 24, a low power state in which a first level of power is supplied to the heating element 24, and a high power state in which a second level of power is supplied to the heating element 24 where the second level of power is greater than the first level of power. However, in other implementations, fewer or greater states may be available to the heating elements 24. For example, each heating element 24 may have an off state in which no power is supplied to the heating element 24 and an on state in which power is supplied to the heating element 24.

Accordingly, a user can set which heating elements 24 (and subsequently which portions of aerosol generating material 44) are to be heated (and optionally to what extent they are to be heated) by interacting with the touch-sensitive panel 29 in advance of generating aerosol. For example, the user may repeatedly tap the regions 29*a* to 29*f* to cycle through the different states (e.g., off, low power, high power, off, etc.). Alternatively, the user may press and hold the region 29*a* to 29*f* to cycle through the different states, where the duration of the press determines the state.

The touch-sensitive panel 29 may be provided with one or more indicators for each of the respective regions 29*a* to 29*f* to indicate which state the corresponding heating element 24 is currently in. For example, the touch-sensitive panel may comprise one or more LEDs or similar illuminating elements, and the intensity of the LEDs signifies the current state of the corresponding heating element 24. Alternatively, a colored LED or similar illuminating element may be provided and the color indicates the current state. Alternatively, the touch-sensitive panel 29 may comprise a display element (e.g., which may underlie a transparent touch-sensitive panel 29 or be provided adjacent to the regions 29*a* to 29*f* of the touch-sensitive panel 29) which displays the current state of the corresponding heating element 24.

When the user has set the configuration for the heating elements 24, in response to detecting the signaling from either one or both of the touch-sensitive panel 29 (and more particularly region 29*g* of touch-sensitive panel 29) and inhalation sensor 30, the control circuitry 23 is configured to supply power to the selected heating elements 24 in accordance with the pre-set configuration.

Accordingly, such simultaneous heating element 24 activations may be dubbed "a simultaneous activation mode", which is primarily designed to deliver a customizable aerosol from a given aerosol provision article 4, with the intention of allowing a user to customize their experience on a session-by-session or even puff-by-puff basis. Hence, this mode may be most effective when portions of the aerosol generating material 44 of the aerosol generating article 4 are different from one another. For example, portions 44*a* and 44*b* are formed of one material, portions 44*c* and 44*d* are formed of a different material, etc. Accordingly, with this mode of operation, the user may select which portions of aerosol generating material 44 to aerosolize at any given moment and thus which combinations of aerosols to be provided with.

In both of the simultaneous and sequential activation modes, the control circuitry 23 may be configured to generate an alert signal which signifies the end of use of the aerosol provision article 4, for example when each of the heating elements 24 has been sequentially activated a predetermined number of times, or when a given heating element 24 has been activated a predetermined number of times and/or for a given cumulative activation time and/or with a given cumulative activation power. In FIG. 1, the aerosol provision device 2 includes an end of use indicator 31 which in this implementation is an LED. However, in other implementations, the end of use indicator 31 may comprise any mechanism which is capable of supplying an alert signal to a user; that is, the end of use indicator 31 may be an optical element to deliver an optical signal, a sound generator to deliver an aural signal, and/or a vibrator to deliver a haptic signal. In some implementations, the indicator 31 may be combined with or otherwise provided by the touch-sensitive panel (e.g., if the touch-sensitive panel includes a display element). The aerosol provision device 2 may prevent subsequent activation of the aerosol provision device 2 when the alert signal is being output. The alert signal may be switched off, and the control circuitry 23 reset, when the user replaces the aerosol provision article 4 and/or switches off the alert signal via a manual means such as a button (not shown).

In more detail, in implementations where the sequential mode of activation is employed, the control circuitry 23 may be configured to count the number of times signaling from either one or both of the touch-sensitive panel 29 and inhalation sensor 30 is received during a period of usage, and once the count reaches a predetermined number, the aerosol provision article 4 is determined to have reached the end of its life. The predetermined number may be equal to, or different from, the number of portions. For example, for an aerosol provision article 4 comprising six discrete portions of aerosol generating material 44, the predetermined number may be six, twelve, eighteen, etc. depending on the exact implementation at hand.

In implementations where the simultaneous mode of activation is employed, the control circuitry 23 may be configured to count the number of times one or each of the discrete portions of aerosol generating material 44 is heated. For example, the control circuitry 23 may count how many times a nicotine containing portion is heated, and when that reaches a predetermined number, determine an end of life of the aerosol provision article 4. Alternatively, the control circuitry 23 may be configured to separately count for each discrete portion of aerosol generating material 44 when that portion has been heated. Each portion may be attributed with the same or a different predetermined number and when any one of the counts for each of the portions of aerosol generating material 44 reaches the predetermined number, the control circuitry 23 determines an end of life of the aerosol provision article 4.

In either of the implementations, the control circuitry 23 may also factor in the length of time the portion of aerosol generating material 44 has been heated for and/or the temperature to which the portion of the aerosol generating material 44 has been heated. In this regard, rather than counting discrete activations, the control circuitry 23 may be configured to calculate a cumulative parameter indicative of the heating conditions experienced by each of the portions of aerosol generating material 44. The parameter may be a cumulative time, for example, whereby the temperature to which the aerosol generating material 44 is heated is used to adjust the length of time added to the cumulative time. For example, a portion of aerosol generating material 44 heated at 200° C. for three seconds may contribute three seconds to the cumulative time, whereas a portion of aerosol generating material 44 heated at 250° C. for three seconds may contribute four and a half seconds to the cumulative time.

The above techniques for determining the end of life of the aerosol provision article 4 should not be understood as an exhaustive list of ways of determining the end of life of the aerosol provision article 4, and in fact any other suitable way may be employed in accordance with the principles of the present disclosure.

Each of the portions of aerosol generating material 44 described above generally has some constituent that is to be delivered in the aerosol for user inhalation when heated, for example nicotine. In some situations, during use of the aerosol provision article 4, each and every discrete portion of aerosol generating material 44 may not be heated by a corresponding heating element 24 (e.g., in the simultaneous activation mode) and/or each and every discrete portion of aerosol generating material 44 may not be heated fully (e.g., in the sequential activation mode). In other words, when the aerosol provision device 2 determines that the aerosol provision article 4 has reached the end of its usable life according to whichever of the above criteria, some of the constituent that is to be delivered may remain within the portion of aerosol generating material 44. It should be appreciated that even during the sequential activation mode, in which each portion of aerosol generating material 44 is heated at least once before the aerosol provision article 4 is determined to be at the end of its life, amounts of the constituent may remain. This may be in part due to the fact that the constituent is effectively "trapped" within the aerosol generating material 44, and requires heating to allow the constituent to be released from the aerosol generating material 44. However, to ensure a rapid release of a sufficient quantity of the aerosol generating material 44 within the duration of a user inhalation, the aerosol generating material 44 may be provided with a higher concentration of the constituent than is actually delivered in an inhalation.

Some of the constituents that remain after initial heating of the aerosol generating material 44 may have a negative impact on the environment should the aerosol provision article 4 not be disposed of correctly. For example, nicotine is known to be toxic, and while the nicotine concentration within the aerosol generating material 44 may be provided at generally safe levels for human consumption, the remaining nicotine may cause harm to certain animals if it enters their food chain due to incorrect disposal of the aerosol provision article 4. The same may be true of other constituents, such as flavorants, for example. While efforts can be made to ensure safe disposal of aerosol provision articles 4 after use, such methods may not be reliable due to a reliance on the user correctly disposing of the aerosol provision article 4.

Therefore, the inventor has devised an aerosol provision system 1 which aims to reduce the level of certain constituents within the remaining portions of aerosol generating material 44 of the aerosol provision article 4 after use of the aerosol provision article 4.

In particular, the inventor has devised a method of reducing the quantity of a first constituent (such as nicotine) in portions of aerosol generating material 44, the method comprising heating the portions of aerosol generating material 44 until the portions of aerosol generating material are substantially free of the first constituent.

Figure 5:
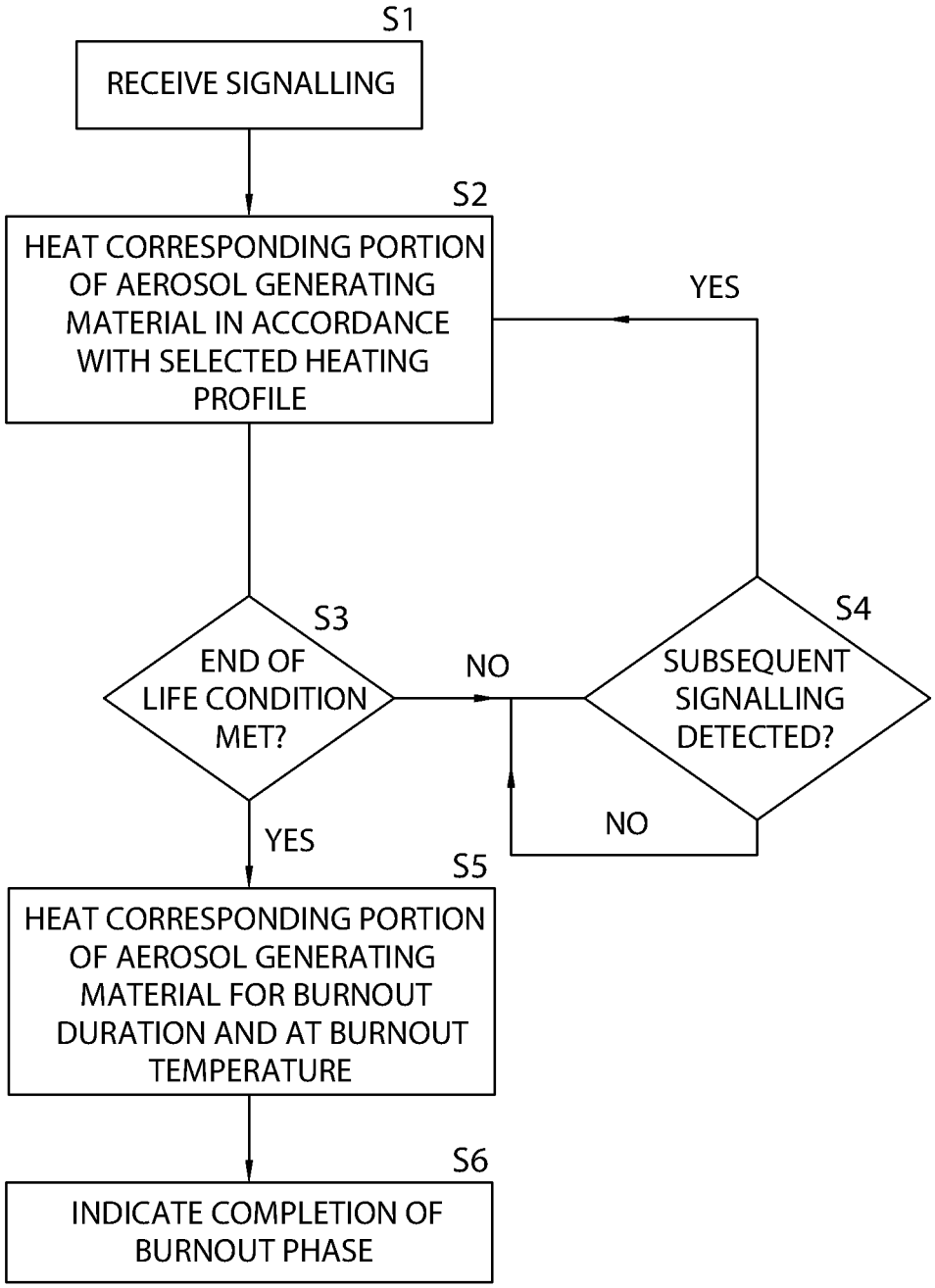
FIG. 5 is a flow chart illustrating a first method for substantially removing a first constituent from an aerosol generating material.

FIG. 5 is a flow chart depicting an exemplary method in accordance with the above for reducing the quantity of a first constituent until the portions of aerosol generating material 44 are substantially free of the first constituent. In this regard, "substantially free of the first constituent" should be understood to mean that the first constituent is present in an amount which is deemed acceptable from the point of view of reliably disposing of the aerosol provision article 4. This amount may vary depending on what the constituent is. For example, with nicotine as the first constituent, the level may be set such that after heating, the concentration of nicotine in the at least a portion of aerosol generating material is less than 0.05 mg/ml, or less than 0.02 mg/ml, when dissolved in 100 ml of solvent. To test the concentrations, a method of taking a sample of material of a fixed mass, such as 1 g, and mixing with 100 ml of solvent (such as ethanol). The mixture is agitated for 3 hours and then passed through a Gas Chromatography—Flame Ionisation Detector (GC-FID) to identify the constituents and concentrations. Other comparative techniques for analysis may also be used in accordance with other implementations.

FIG. 5 shows a method for reducing the quantity of a first constituent in one or more portions of aerosol generating material 44 of the aerosol provision article 4 shown in FIGS. 2A to 2C when the sequential activation method is used, and more specifically where each portion of aerosol generating material 44 is heated once to generate aerosol for user inhalation.

The method starts at step S1, where the aerosol provision device 2 receives signaling from either one or both of the touch-sensitive panel 29 and inhalation sensor 30 signifying a user's intention to inhale aerosol, as discussed above. The aerosol provision device 2 may already be in a "stand-by" state prior to step S1 and as such the control circuitry 23 is in a state where it is monitoring for the signaling.

Once the control circuitry 23 has received the signaling at step S1, the control circuitry 23 is configured to heat a corresponding portion of the aerosol generating material 44 in accordance with the sequential activation mode as discussed previously at step S2. In particular, in response to receiving a first signaling at step S1, the control circuitry 23 may be configured to cause heating of aerosol generating material portion 44*a*. The heating occurs in accordance with a heating profile for the portions of aerosol generating material 44. The heating profile may be selected for generating a suitable aerosol both in terms of quantity and also sensorial quality (that is, an aerosol that has sufficient quantity and quality to satisfy a user's requirement). The temperature that the portion of aerosol generating material 44 is heated to may be determined in advance to give a certain desired aerosol, but for an amorphous solid aerosol generating material is found to be in the range of 120° C. to 350° C. depending on the precise formulation of the amorphous solid used. The duration of heating may be set in advance or may depend up on the length of the user's puff, as discussed previously. However, typically the duration of heating will be on the order of 2 to 5 seconds, and in most implementations will be no longer than 10 seconds. In some implementations where the length of heating is based on the user's puff duration, a cut-off may be implemented in which power to the heating elements 24 is stopped after 10 seconds of inhalation to prevent abuse of the aerosol provision system 1.

When a single portion of aerosol generating material 44 is to be heated under step S2, then the single portion of aerosol generating material 44 may be said to be heated at a first temperature for a first duration.

Once a heating phase has been performed (that is, once the heating element 24 has been activated and deactivated once), at step S3 the control circuitry 23 determines whether an end of life condition of the aerosol provision article 4 has been met.

If an end of life condition has not been met (i.e., NO at step S3), then the method proceeds to step S4 where the control circuitry 23 monitors for subsequent signaling indicating a user's desire to generate aerosol once again. If said signaling is received (i.e., YES at step S4), then the control circuitry 23 causes heating of the corresponding portion of aerosol generating material 44 in accordance with the selected activation method at step S2. In this example, the control circuitry 23 is configured to sequentially cause heating of portions 44*b*, 44*c*, 44*d*, 44*e*, and finally 44*f*. Assuming an end of life condition has not been detected, the method proceeds to loop between steps S2, S3, and S4.

In this example implementation, the end of life condition is determined when a count of the number of instances of signaling received by the control circuitry 23 is greater than a threshold. In this example, the threshold is six, such that when six separate instances of signaling are detected at steps S1 and S4 combined, the control circuitry 23 determines that the aerosol provision article 4 has reached its end of life. That is, when this criteria is met, the control circuitry 23 determines that an end of life condition is met (i.e., YES at step S3). In other words, this can be considered one way of determining when a session of usage has completed, assuming that one aerosol provision article 4 is intended to be used for one session.

In response to an end of life condition being met, the control circuitry 23 is configured to activate a "purge" or "burnout" mode at step S5. This involves the control circuitry 23 causing heating of each of the portions of aerosol generating material 44 for a second duration and at a second temperature. The second duration and second temperature are selected such that after exposure to this phase of heating, the aerosol generating material is substantially free of a first constituent, e.g., nicotine.

In the case of a nicotine containing amorphous solid comprising 4.68 mg nicotine (in an 8×8 mm square patch of gel, weighing 0.1 g total), after a heating period of three minutes at 170° C., the concentration of nicotine was found to be less than 0.02 mg/ml, when dissolved in 100 ml of solvent, and analyzed using a Blend Analysis method. That is, after heating for a prolonged period of time, the nicotine is substantially removed from the aerosol generating material 44.

However, it should be appreciated that, depending on the composition of the aerosol generating material 44 and the constituent to be removed, different heating times (i.e., the second duration) and different maximum temperatures may be implemented. However, generally speaking, the greater the maximum temperature the shorter the heating time required to substantially remove the first constituent from the portions of aerosol generating material 44. Equally, the volatility of the first constituent may also play a part in determining the maximum temperature and heating period. The various heating times and maximum heating temperatures may be determined empirically or via computer simulation.

In some implementations, the heating time period/second duration may be greater than 60 seconds (one minute), or greater than 90 seconds (one and a half minutes), or greater than 120 seconds (two minutes), or greater than 150 seconds (two and a half minutes), or greater than 180 seconds (three minutes). That is, the heating time period may be substantially longer than the heating time period for generating aerosol for one user inhalation, where one user inhalation may be less than 10 seconds, for example between five times as long to thirty times as long. Providing a heating time period that is too short may lead to not all of the aerosol generating material 44 being substantially free of the first constituent after the heating period, whereas providing a heating period that is too long will heat aerosol generating material 44 beyond the point at which the portion of aerosol generating material 44 is free of the first constituent and thus energy from the power source 22 is used unnecessarily. The length of time of the heating period may be dependent on the thickness of the aerosol generating material 44 to be heated during the heating period (e.g., a thicker material may lead require a longer heating period). The above durations may be particularly suitable for portions of aerosol generating material 44 having a thickness of between 400 μm to 1 mm.

In some implementations, the maximum temperature is no greater than 350° C., or no greater than 300° C., or no greater than 250° C. In some implementations, the maximum temperature may be selected from the range of 150° C. to 220° C. Providing a maximum temperature which is too low may lead to not all of the aerosol generating material 44 being substantially free of the first constituent after the heating period, whereas providing a maximum temperature that is too high may lead to charring or burning of the aerosol generating material 44 which may generate unwanted constituents that may be difficult to dispose of in an environmentally-friendly way. In some implementations, the maximum temperature employed in step S5 may be the same as the maximum temperature employed in step S3. That is, the maximum temperature used to heat the portion of the aerosol generating material 44 comprising the first constituent to generate an aerosol for user inhalation is substantially the same as the maximum temperature used to heat the at least the portion of the aerosol generating material 44 until the at least the portion of the aerosol generating material 44 is substantially free of the first constituent. In other implementations, the maximum temperature used in step S5 may be greater than the maximum temperature used in step S3.

Although not shown, optionally during step S5, the aerosol provision device 2 may be configured to output a signal using indicator 31 to signify to the user that the burnout mode is in progress. For example, the indicator 31 may be an LED and configured to output a flashing or blinking light during the heating period. Any other form of indicator unit which can output a signal to the user as described above may also be employed. During the burnout mode, the user should refrain from inhaling on the aerosol provision device 2, and the indicator 31 can help guide the user in this regard.

At step S6, when the heating time period has elapsed, the indicator 31 may provide a different output to signify to the user that the burnout mode has completed. For example, the indicator 31 may output a solid light to indicate that burnout mode is complete and that the user may remove the aerosol provision article 4 and dispose of the aerosol provision article 4 using conventional means (e.g., in a waste disposal bin). Again, the indicator 31 may be any type of indicator and output any type of signal as appropriate.

In the aforementioned exemplary method of FIG. 5, the control circuitry 23 is configured to sequentially activate the plurality of heating elements 24 in turn to heat the corresponding portions of aerosol generating material 44 such that each portion of aerosol generating material 44 is heated once. However, the same method can be applied should each portion of aerosol generating material 44 be heated a plurality of times, e.g., twice. In these instances, the control circuitry 23 may be configured to sequentially heat each heating element 24 e.g., twice before determining an end of life condition has been met at step S3. The heating elements 24 may be activated in the sequence 24*a*, 24*b* . . . 24*f*, 24*a*, 24*b* . . . 24*f*, or may be heated in the sequence 24*a*, 24*a*, 24*b*, 24*b* . . . 24*f*, 24*f* for instance. However, other suitable heating sequences may be employed accordingly.

Equally, at step S5, the duration for which the plurality of heating elements 24 are to be heated until the portions of the aerosol generating material are substantially free of the first constituent may be determined to take into account the number of times the heating elements 24 have been activated. For example, suppose each heating element 24 is activated for 10 seconds, and it is found that for a fresh portion of aerosol generating material 44 is to be heated for 90 seconds at 250° C. to make the portion substantially free of the first constituent, the control circuitry 23 may be programmed to heat the used portions of aerosol generating material 44 for the duration found to make a fresh portion of aerosol generating material 44 substantially free of the first constituent (e.g., 90 seconds) minus the total heater activation duration (e.g., 10 seconds if each portion is heated once, 20 seconds if each portion is heated twice, etc. in this example). In some implementations, where the maximum temperature used at step S3 is not the same as that used at step S5, the total heater activation time may be modified by the maximum temperature used. For example, if the portions of aerosol generating material 44 are heated with a maximum temperature of 170° C. during step S3 for 10 seconds, it may be that this equates to an equivalent heating period of say 5 seconds at the maximum temperature of step S5 (e.g., 250° C.) in terms of the amount of nicotine released. In this way, the power provided by the power supply 22 may be more efficiently used.

In other implementations, the duration of heating used in step S5 to make the portions of aerosol generating material 44 substantially free of the first constituent is set irrespective of the heating element activation time(s). This may ensure, for example, that should any portions of aerosol generating material 44 not be heated to generate aerosol for user inhalation that these portions of aerosol generating material 44 are substantially free of the first constituent when heated under step S5.

Figure 6:
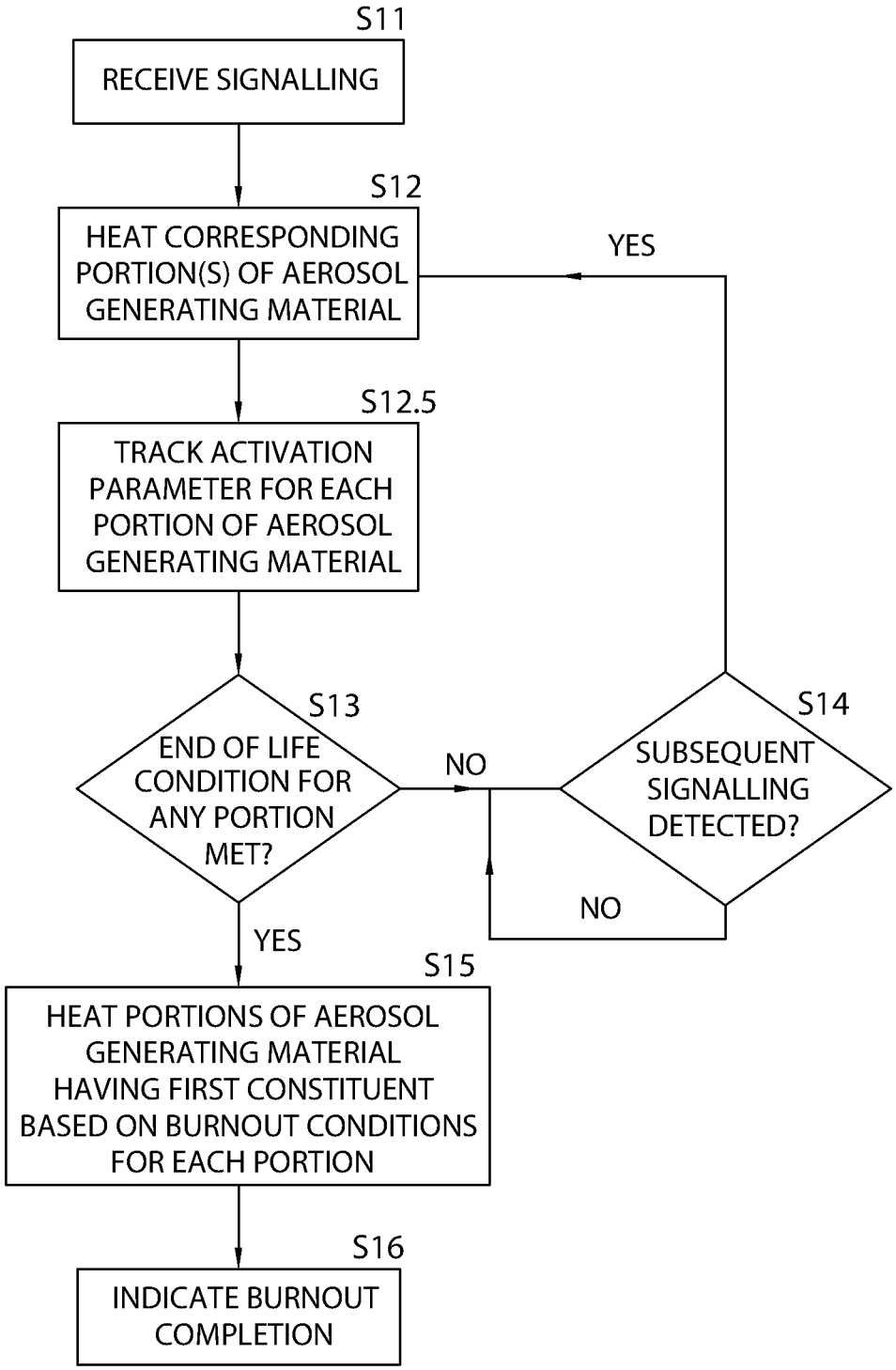
FIG. 6 is a flow chart illustrating a second method for substantially removing a first constituent from an aerosol generating material.

In other implementations, the control circuitry 23 may be configured to track which portions of aerosol generating material 44 are heated (and optionally for how long), and provide a customized heating profile for each of the portions of aerosol generating material 44 to ensure that each portion of the aerosol generating material 44 is substantially free of the first constituent. This method may be particularly suited to the simultaneous activation method described above, and particularly (although not exclusively) when at least some of the portions of aerosol generating material 44 of the aerosol provision article 4 are different from one another. FIG. 6 is flow chart such an exemplary process.

The method starts at step S11, which is substantially similar to step S1 described above and a description thereof is not repeated for conciseness.

Once the control circuitry 23 has received the signaling at step S11, the control circuitry 23 is configured to heat a corresponding portion of the aerosol generating material 44 in accordance with the simultaneous activation mode (as discussed previously) at step S12. As described, in the simultaneous activation mode one or more of the plurality of portions of aerosol generating material 44 are selected to be heated to generate an aerosol for user inhalation, e.g., portions 44*a* and 44*b*. Each of these portions 44*a*, 44*b* may be heated to a unique temperature and for a unique duration to deliver the desired aerosol in accordance with the heating configuration set in advance. For example, portion 44*a* may be heated at 200° C. for 2 seconds, while portion 44*b* may be heated at 170° C. for 3 seconds.

Either during step S12 or after (e.g. at step S12.5), the control circuitry 23 is configured to track an activation parameter for each of the portions of aerosol generating material 44. In practical terms, the control circuitry 23 may keep a running log for each heating element 24 (or portion of aerosol generating material 44), and the control circuitry 23 updates the running log of the activation parameter for the heating element(s) 24 or portion(s) of aerosol generating material 44 that have been heated during step S12.

The activation parameter may be any suitable parameter for monitoring activation of the portions of aerosol generating material 44. In one implementation, the activation parameter may be a measure of the number of discrete times the portion of aerosol generating material 44 is heated. In these implementations, the control circuitry 23 may store a number of activations against each of the heating elements 24 or each of the portions of aerosol generating material 44, and each time a heating element or portion is heated at step S12, the control circuitry increases the number by one. In other implementations, the activation parameter may be the cumulative heating time the portion is heated for. For instance, in these implementations, the control circuitry 23 may store a time against each of the heating elements 24 or each of the portions of aerosol generating material 44. During or after step S12, the control circuitry 23 is configured to increase the time value associated with the corresponding heating elements or portions based on the length of time each portion of aerosol generating material 44 is heated for during step S12. In yet other implementations, the activation parameter may be a weighted cumulative heating time the portion is heated for. For instance, in these implementations, the control circuitry 23 may store a time against each of the heating elements 24 or each of the portions of aerosol generating material 44. During or after step S12, the control circuitry 23 is configured to increase the time value associated with the corresponding heating elements 24 or portions of aerosol generating material 44 based on the length of time each portion of aerosol generating material 44 is heated for during step S12 and also the temperature to which the heating element 24 or portion of aerosol generating material 44 is heated to, in a manner similar to that discussed above in relation to FIG. 5. It should be appreciated that other ways of characterizing the activation of the individual heating elements 24 and/or portions of aerosol generating material 44 may be employed in accordance with the principles of the present disclosure.

Once a heating phase has been performed (that is, once the respective heating element(s) 24 have been activated and deactivated once), at step S13 the control circuitry 23 determines whether an end of life condition of the aerosol provision article 4 has been met. However, unlike step S3 of FIG. 5, at step S13, each portion of aerosol generating material 44 may be associated with a corresponding end of life condition due to the fact that in the simultaneous mode of activation certain portions of aerosol generating material 44 may be heated more than others. The end of life conditions may be the substantially the same or different for each composition of aerosol generating material 44.

If an end of life condition has not been met for any one of the portions of aerosol generating material 44 (i.e., NO at step S13), then the method proceeds to step S14 where the control circuitry 23 monitors for subsequent signaling indicating a user's desire to generate aerosol once again. If said signaling is received (i.e., YES at step S14), then the control circuitry 23 causes heating of the corresponding portion of aerosol generating material 44 in accordance with the selected heating configuration (which, as discussed above, may change from puff-to-puff). Assuming an end of life condition has not been detected, the method proceeds to loop between steps S12, S13, and S14.

In this example implementation, the end of life condition may depend on the nature of the monitored activation parameter. For example, the end of life condition may be a count value (e.g., six counts signifying six separate heating occurrences of that portion of aerosol generating material) or a time period.

In this example, when it is determined that an end of life condition is met for any one of the portions aerosol generating material 44 (i.e., YES at step S13), then the method proceeds to step S15 to activate the "purge" or "burnout" mode. However, it should be appreciated that in some implementations, a YES at step S13 may only be made if certain portions of aerosol generating material 44 are determined to have reached their end of life (e.g., portions with nicotine), or when every portion of aerosol generating material 44 is determined to have reached it's end of life. In these implementations, the aerosol provision device 2 may be configured to indicate (e.g., via touch-sensitive panel 29 or indicator 31) that certain portions of aerosol generating material 44 are no longer available and cannot be heated, thus permitting the user the chance to alter the heating configuration of the simultaneous activation mode for subsequent puffs.

In response to an (or all) end of life condition(s) being met, the control circuitry 23 is configured to activate a "purge" or "burnout" mode at step S15. This is substantially similar to step S5 described in FIG. 5 above. The duration and temperature to which the portions of aerosol generating material 44 are heated in the burnout mode may be predetermined and applied regardless of the activation history of the heating element or portion of aerosol generating material 44. However, in the described implementation, the duration and temperature for each heating element or portion may be determined based on the monitored activation parameter (e.g., by taking a total time required to heat a fresh portion of the aerosol generating material 44 in consideration and subtracting the monitored activation parameter or an attributed time value therefrom), substantially in accordance with the principles described in relation to FIG. 5.

In some implementations, the control circuitry may be configured to set the temperatures to which each of the heating elements 24 are heated to such that the heating periods for all portions of aerosol generating material 44 are approximately the same. For example, a portion of aerosol generating material 44 which has half as much nicotine as another portion may be heated at 150° C. for 60 seconds, whereas a portion of aerosol generating material 44 having twice as much nicotine may be heated at 200° C. for 60 seconds to enable the burnout mode for each portion of aerosol generating material 44 to be completed at approximately the same time.

At step S16, when the heating time period has elapsed, the indicator 31 may output a different signify to the user to indicate that the burnout mode has completed. For example, the indicator 31 may output a solid light to indicate that burnout mode is complete and that the user may remove the aerosol provision article 4 and dispose of the aerosol provision article 4 using conventional means (e.g., in a waste disposal bin). Again, the indicator 31 may be any type of indicator and output any type of signal as appropriate.

Regardless of the method used, providing a burnout mode may allow the user to remove unwanted constituents from aerosol generating material 44, such that the aerosol provision article 4 containing the material can be safely disposed of. Although not shown, the aerosol provision device 2 may comprise a storage portion for storing the aerosol generated during the burnout process, so that the aerosol can be disposed of appropriately and at an appropriate time. In other implementations, the aerosol may deposit on the walls of the receptacle 25 and require a user to clean the receptacle 25 with an associated cleaning utensil. In either case, the user may dispose of the aerosol provision article 4 in any suitable or conventional manner (for example, when away from a suitable disposal facility), and then clean the aerosol provision device 2 at a time when it is more appropriate and when able to use a suitable disposal facility.

While the implementations above have focused on removing a first constituent from an aerosol generating material 44, it should be appreciated that multiple constituents may be removed either from the same portion of aerosol generating material 44 or different portions of aerosol generating material 44. For example, a burnout mode for removing a flavorant may also be employed. In these implementations, the burnout modes may be run in parallel. For portions of aerosol generating material 44 that have both constituents, the control circuitry 23 may be configured to select the longer and/or higher temperature burnout mode to be applied to that portion so as to ensure that both constituents are substantially removed from the aerosol generating material 44.

While it has been described that the burnout mode (e.g., steps S5 and S15) are implemented automatically, in other implementations, the user may be provided with the option to manually begin the burnout mode (that is, the user may manually select heating at least the portion of the aerosol generating material 44 until the at least the portion of the aerosol generating material 44 is substantially free of the first constituent). In these implementations, the user may be provided with a warning/alert that the aerosol provision article 4 is approaching an end of life condition, e.g. using indicator 31. The user may interact with the touch-sensitive panel 29 for example, to engage the burnout mode.

It should be appreciated that, in some implementations, the burnout mode may be applied only to portions of aerosol generating material 44 that contain the first constituent (and any other selected constituents that are desired to be removed). In other words, the control circuitry 23 may be configured to selectively apply the burnout mode to selected portions of aerosol generating material 44.

In some implementations, the aerosol provision device 2 may optionally include a blocking or flow restriction member 32. The flow restriction member 32 may be any suitable component for selectively sealing the air flow path in the aerosol provision device 2. In FIG. 1, the flow restriction member 32 is a flap which can be moved from a stowed position which permits airflow to a block position which substantially seals the airflow path. However, in other implementations, the flow restriction member may be a butterfly valve, or an iris structure, for example. The flow restriction member 32 is shown in FIG. 1 as being located toward the air outlet 28, but could be located at any suitable position along the flow path downstream of the receptacle 25. During steps S5 and S15 of the methods shown in FIGS. 5 and 6, the control circuitry 23 may be configured to actuate the flow restriction member 32 to thereby seal the airflow pathway. In this case, when the user inhales on the mouthpiece end 26 of the device 2, the user is unable to inhale air which is located upstream of the flow restriction member 32. In this way, safety may be improved as the user is unable to inhale when the burnout mode is activated.

Figure 7:
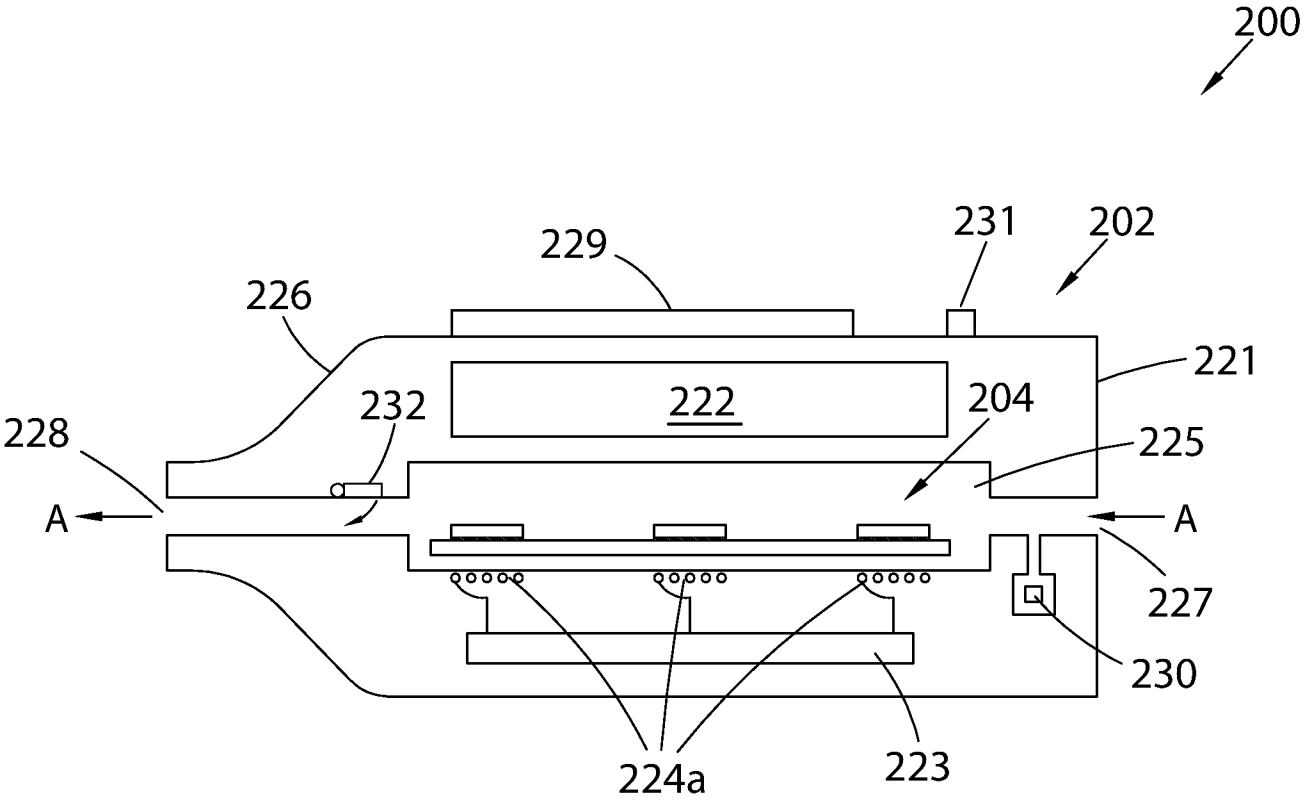
FIG. 7 is a cross-sectional view of a schematic representation of an embodiment of an aerosol provision system comprising an aerosol provision device and an aerosol provision article (e.g. an aerosol generating article), the device comprising a plurality of induction work coils and the article comprising a plurality of portions of aerosol generating material and corresponding susceptor portions.

FIG. 7 is a cross-sectional view through a schematic representation of an aerosol provision system 200 in accordance with another embodiment of the disclosure. The aerosol provision system 200 includes components that are broadly similar to those described in relation to FIG. 1; however, the reference numbers have been increased by 200. For efficiency, the components having similar reference numbers should be understood to be broadly the same as their counterparts in FIGS. 1 and 2A to 2C unless otherwise stated.

The aerosol provision device 202 comprises an outer housing 221, a power source 222, control circuitry 223, induction work coils 224*a*, a receptacle 225, an inhalation or mouthpiece end 226, an air inlet 227, an air outlet 228, a touch-sensitive panel 229, an inhalation sensor 230, an end of use indicator 231 and flow restriction member 232.

Figure 8B:
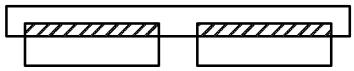
FIG. 8B is an end-on view along the longitudinal (length) axis of the aerosol generating article of FIG. 7.
Figure 8A:
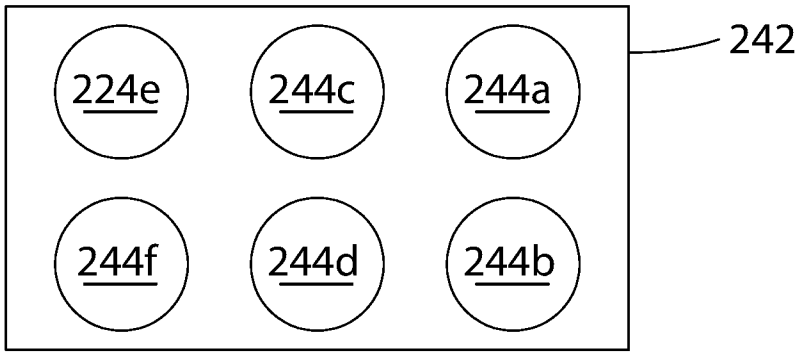
FIG. 8A is a top-down view of the aerosol provision article of FIG. 7.
Figure 8C:
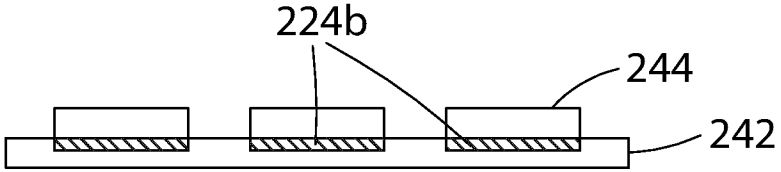
FIG. 8C is a side-on view along the width axis of the aerosol generating article of FIG. 7.

The aerosol provision article 204 comprises a carrier component 242, aerosol generating material 244, and susceptor elements 244*b*, as shown in more detail in FIGS. 8A to 8C. FIG. 8A is a top-down view of the aerosol provision article 204, FIG. 8B is an end-on view along the longitudinal (length) axis of the aerosol provision article 204, and FIG. 8C is a side-on view along the width axis of the aerosol provision article 204.

FIGS. 7 and 8 represent an aerosol provision system 200 which uses induction to heat the aerosol generating material 244 to generate an aerosol for inhalation.

In the described implementation, the aerosol generating component 224 is formed of two parts; namely, induction work coils 224*a* which are located in the aerosol provision device 202 and susceptors 224*b* which are located in the aerosol provision article 204. Accordingly, in this described implementation, each aerosol generating component 224 comprises elements that are distributed between the aerosol provision article 204 and the aerosol provision device 202.

Induction heating is a process in which an electrically-conductive object, referred to as a susceptor, is heated by penetrating the object with a varying magnetic field. The process is described by Faraday's law of induction and Ohm's law. An induction heater may comprise an electromagnet and a device for passing a varying electrical current, such as an alternating current, through the electromagnet. When the electromagnet and the object to be heated are suitably relatively positioned so that the resultant varying magnetic field produced by the electromagnet penetrates the object, one or more eddy currents are generated inside the object. The object has a resistance to the flow of electrical currents. Therefore, when such eddy currents are generated in the object, their flow against the electrical resistance of the object causes the object to be heated. This process is called Joule, ohmic, or resistive heating.

A susceptor is material that is heatable by penetration with a varying magnetic field, such as an alternating magnetic field. The heating material may be an electrically-conductive material, so that penetration thereof with a varying magnetic field causes induction heating of the heating material. The heating material may be magnetic material, so that penetration thereof with a varying magnetic field causes magnetic hysteresis heating of the heating material. The heating material may be both electrically-conductive and magnetic, so that the heating material is heatable by both heating mechanisms.

Magnetic hysteresis heating is a process in which an object made of a magnetic material is heated by penetrating the object with a varying magnetic field. A magnetic material can be considered to comprise many atomic-scale magnets, or magnetic dipoles. When a magnetic field penetrates such material, the magnetic dipoles align with the magnetic field. Therefore, when a varying magnetic field, such as an alternating magnetic field, for example as produced by an electromagnet, penetrates the magnetic material, the orientation of the magnetic dipoles changes with the varying applied magnetic field. Such magnetic dipole reorientation causes heat to be generated in the magnetic material.

When an object is both electrically-conductive and magnetic, penetrating the object with a varying magnetic field can cause both Joule heating and magnetic hysteresis heating in the object. Moreover, the use of magnetic material can strengthen the magnetic field, which can intensify the Joule heating.

In the described implementation, the susceptors 224*b* are formed from an aluminum foil, although it should be appreciated that other metallic and/or electrically conductive materials may be used in other implementations. As seen in FIG. 8A, the carrier component 242 comprises a number of susceptors 224*b* which correspond in size and location to the discrete portions of aerosol generating material 244 disposed on the surface of the carrier component 242. That is, the susceptors 224*b* have a similar width and length to the discrete portions of aerosol generating material 244.

The susceptors 224*b* are shown embedded in the carrier component 242. However, in other implementations, the susceptors 224*b* may be placed on the surface of the carrier component 242.

The aerosol provision device 202 comprises a plurality of induction work coils 224*a* shown schematically in FIG. 7. The induction work coils 224*a* are shown adjacent the receptacle 225, and are generally flat coils arranged such that the rotational axis about which a given coil is wound extends into the receptacle 225 and is broadly perpendicular to the plane of the carrier component 242 of the aerosol provision article 204. The exact windings are not shown in FIG. 7 and it should be appreciated that any suitable induction coil may be used.

The control circuitry 223 comprises a mechanism to generate an alternating current which is passed to any one or more of the induction work coils 224*a*. The alternating current generates an alternating magnetic field, as described above, which in turn causes the corresponding susceptor(s) 224*b* to heat up. The heat generated by the susceptor(s) 224*b* is transferred to the portions of aerosol generating material 244 accordingly.

As described above in relation to FIGS. 1 and 2A to 2C, the control circuitry 223 is configured to supply current to the work coils 224*a* in response to receiving signaling from the touch sensitive panel 229 and/or the inhalation sensor 230. Any of the techniques for selecting which heating elements 24 are heated by control circuitry 23 as described previously may analogously be applied to selecting which work coils 224*a* are energized (and thus which portions of aerosol generating material 244 are subsequently heated) in response to receiving signaling from the touch sensitive panel 229 and/or the inhalation sensor 230 by control circuitry 223 to generate an aerosol for user inhalation.

Although the above has described an induction heating aerosol provision system where the work coils 224*a* and susceptors 224*b* are distributed between the aerosol provision article 204 and aerosol provision device 202, an induction heating aerosol provision system may be provided where the work coils 224*a* and susceptors 224*b* are located solely within the aerosol provision device 202. For example, with reference to FIG. 7, the susceptors 224*b* may be provided above the induction work coils 224*a* and arranged such that the susceptors 224*b* contact the lower surface of the carrier component 242 (in an analogous way to the aerosol provision system 1 shown in FIG. 1).

Thus, FIG. 7 describes a more concrete implementation where induction heating may be used in an aerosol provision device 202 to generate aerosol for user inhalation to which the techniques described in the present disclosure may be applied.

In the implementations of the aerosol provision systems 1, 201 described above, a plurality of (discrete) portions of aerosol generating material 44, 244 are provided which can be selectively aerosolized using the aerosol generating components 24, 224 (e.g., heating elements). Such aerosol provision systems 1, 201 offer advantages over other systems which are designed to heat a larger bulk quantity of material. In particular, for a given inhalation, only the selected portion (or portions) of aerosol generating material 44, 244 are aerosolized leading to a more energy efficient system overall.

In heated systems, several parameters affect the overall effectiveness of the system at delivering a sufficient amount of aerosol to a user on a per puff basis. On the one hand, the thickness of the aerosol generating material 44, 244 is important as this influences how quickly the aerosol generating material 44, 244 reaches an operational temperature (and subsequently generates aerosol). This may be important for several reasons, but may lead to more efficient use of energy from the power source 22, 222 as the heating element 24, 224 may not need to be active for as long compared with heating a thicker portion of aerosol generating material 44, 244. On the other hand, the total mass of the aerosol generating material 44, 244 that is heated affects the total amount of aerosol that can be generated, and subsequently delivered to the user. In addition, the temperature that the aerosol generating material 44, 244 is heated to may affect both how quickly the aerosol generating material 44, 244 reaches operational temperature and the amount of aerosol that is generated. The target temperature (which may also be referred to as the operational temperature) is a temperature that the control circuitry 23, 223 causes the heating element 24, 224 to reach to generate an aerosol. The operational temperature may therefore be one or more fixed values.

Amorphous solids (e.g., as described above) are particularly suited to the above application, in part because the amorphous solids are formed from selected ingredients/constituents and so can be engineered such that a relatively high proportion of the mass is the useful (or deliverable) constituents (e.g., nicotine and glycerol, for example). As such, amorphous solids may produce a relatively high proportion of aerosol from a given mass as compared to some other aerosol generating materials (e.g., tobacco), meaning that relatively smaller portions of amorphous solid can output a comparable amount of aerosol. In addition, amorphous solids do not tend to easily flow (if at all) which means problems around leakage when using a liquid aerosol generating material, for example, are largely mitigated.

Although the above has described a system in which an array of aerosol generating components 24 (e.g., heating elements 24) are provided to energize the discrete portions of aerosol generating material 44, in other implementations, the aerosol provision article 4 and/or an aerosol generating component 24 may be configured to move relative to one another. That is, there may be fewer aerosol generating components 24 than discrete portions of aerosol generating material 44 provided on the carrier component 42 of the aerosol provision article 4, such that relative movement of the aerosol provision article 4 and aerosol generating components 24 is required in order to be able to individually energize each of the discrete portions of aerosol generating material 44. For example, a movable heating element 24 may be provided within the receptacle 25 such that the heating element 24 may move relative to the receptacle 25. In this way, the movable heating element 24 can be translated (e.g., in the width and length directions of the carrier component 42) such that the heating element 24 can be aligned with respective ones of the discrete portions of aerosol generating material 44. This approach may reduce the number of carrier components 42 required while still offering a similar user experience.

Although the above has described implementations where discrete, spatially distinct portions of aerosol generating material 44 are deposited on a carrier component 42, it should be appreciated that in other implementations the aerosol generating material 44 may not be provided in discrete, spatially distinct portions but instead be provided as a continuous sheet of aerosol generating material 44. In these implementations, certain regions of the sheet of aerosol generating material 44 may be selectively heated to generate aerosol in broadly the same manner as described above. However, regardless of whether or not the portions are spatially distinct, the present disclosure describes heating (or otherwise aerosolizing) portions of aerosol generating material 44. In particular, a region (corresponding to a portion of aerosol generating material 44) may be defined on the continuous sheet of aerosol generating material 44 based on the dimensions of the heating element 24 (or more specifically a surface of the heating element 24 designed to increase in temperature). In this regard, the corresponding area of the heating element 24 when projected onto the sheet of aerosol generating material 44 may be considered to define a region or portion of aerosol generating material 44. In accordance with the present disclosure, each region or portion of aerosol generating material 44 may have a mass no greater than 20 mg, however the total continuous sheet of aerosol generating material may have a mass which is greater than 20 mg.

Although the above has described a "burnout mode" in which portions of aerosol generating material 44 are heated to reduce the concentrations of the constituents to a relatively low level, it should be appreciated that in some implementations, a different form of aerosolization may be used, e.g., a vibrating mesh. Accordingly, the principles described above may be applied to a method of reducing the quantity of a first constituent in aerosol generating material 44 using an aerosol provision device 2 configured to deliver inhalable aerosol to a user, the method comprising: performing a first aerosolization process on a portion of the aerosol generating material 44 comprising the first constituent to generate an aerosol for user inhalation; and performing a second aerosolization process on at least the portion of the aerosol generating material 44 until the at least the portion of the aerosol generating material 44 is substantially free of the first constituent. An aerosolization process should be understood as any suitable process which can generate aerosol from the aerosol generating material 44.

Although the above has described implementations where the aerosol provision device 2 can be configured or operated using the touch-sensitive panel 29 mounted on the aerosol provision device 2, the aerosol provision device 2 may instead be configured or controlled remotely. For example, the control circuitry 23 may be provided with a corresponding communication circuitry (e.g., Bluetooth) which enables the control circuitry 23 to communicate with a remote device such as a smartphone. Accordingly, the touch-sensitive panel 29 may, in effect, be implemented using an App or the like running on the smartphone. The smartphone may then transmit user inputs or configurations to the control circuitry 23, and the control circuitry 23 may be configured to operate on the basis of the received inputs or configurations.

Although the above has described implementations in which an aerosol is generated by energizing (e.g., heating) aerosol generating material 44 which is subsequently inhaled by a user, it should be appreciated in some implementations that the generated aerosol may be passed through or over an aerosol modifying component to modify one or more properties of the aerosol before being inhaled by a user. For example, the aerosol provision device 2, 202 may comprise an air permeable insert (not shown) which is inserted in the airflow path downstream of the aerosol generating material 44 (for example, the insert may be positioned in the outlet 28). The insert may include a material which alters any one or more of the flavor, temperature, particle size, nicotine concentration, etc. of the aerosol as it passes through the insert before entering the user's mouth. For example, the insert may include tobacco or treated tobacco. Such systems may be referred to as hybrid systems. The insert may include any suitable aerosol modifying material, which may encompass the aerosol generating materials described above.

Although it has been described above that the heating elements 24 are arranged to provide heat to a portion of aerosol generating material 44 at an operational temperature at which aerosol is generated from the portion of aerosol generating material 44, in some implementations, the heating elements 24 are arranged to pre-heat portions of the aerosol generating material 44 to a pre-heat temperature (which is lower than the operational temperature). At the pre-heat temperature, a lower amount or no aerosol is generated when the portion is heated at the pre-heat temperature. However, a lower amount of energy is required to raise the temperature of the aerosol generating material from the pre-heat temperature to the operational temperature. This may be particularly suitable for relatively thicker portions of aerosol generating material 44, e.g., having thicknesses above 400 μm which require relatively larger amounts of energy to be supplied in order to reach the operational temperature. In such implementations, the energy consumption (e.g., from the power source 22) may be comparably higher, however.

Although the above has described implementations in which the aerosol provision device 2 comprises an end of use indicator 31, it should be appreciated that the end of use indicator 31 may be provided by another device remote from the aerosol provision device 2. For example, in some implementations, the control circuitry 23 of the aerosol provision device 2 may comprise a communication mechanism which allows data transfer between the aerosol provision device 2 and a remote device such as a smartphone or smartwatch, for example. In these implementations, when the control circuitry 23 determines that the aerosol provision article 4 has reached its end of use, the control circuitry 23 is configured to transmit a signal to the remote device, and the remote device is configured to generate the alert signal (e.g., using the display of a smartphone). Other remote devices and other mechanisms for generating the alert signal may be used as described above.

In some implementations, the article 4 may comprise an identifier, such as a readable bar code or an RFID tag or the like, and the aerosol provision device 2 comprises a corresponding reader. When the aerosol provision article 4 is inserted into the receptacle 25 of the aerosol provision device 2, the aerosol provision device 2 may be configured to read the identifier on the aerosol provision article 4. The control circuitry 23 may be configured to either recognize the presence of the aerosol provision article 4 (and thus permit heating and/or reset an end of life indicator) or identify the type and/or the location of the portions of the aerosol generating material 44 relative to the aerosol provision article 4. This may affect which portions the control circuitry 23 aerosolizes and/or the way in which the portions are aerosolized, e.g., via adjusting the aerosol generation temperature and/or heating duration. Any suitable technique for recognizing the aerosol provision article 4 may be employed.

Thus, there has been described a method of reducing the quantity of a first constituent in aerosol generating material using an aerosol generating device configured to deliver inhalable aerosol to a user. The method comprises performing a first aerosolization process (S2) on a portion of the aerosol generating material comprising the first constituent to generate an aerosol for user inhalation, and performing a second aerosolization process (S5) on at least the portion of the aerosol generating material until the at least the portion of the aerosol generating material is substantially free of the first constituent. Also provided is an aerosol provision device and an aerosol provision system.

In addition, when the portions of aerosol generating material 44 are provided on a carrier component 42, the portions may, in some implementations, include weakened regions, e.g., through holes or areas of relatively thinner aerosol generating material 44, in a direction approximately perpendicular to the plane of the carrier component 42. This may be the case when the hottest part of the aerosol generating material 44 is the area directly contacting the carrier component 42 (in other words, in scenarios where the heat is applied primarily to the surface of the aerosol generating material that contacts the carrier component 42). Accordingly, the through holes may provide channels for the generated aerosol to escape and be released to the environment/the air flow through the aerosol provision device 2 rather than causing a potential build-up of aerosol between the carrier component 42 and the aerosol generating material 44. Such build-up of aerosol can reduce the heating efficiency of the aerosol provision system 1 as the build-up of aerosol can, in some implementations, cause a lifting of the aerosol generating material 44 from the carrier component 42 thus decreasing the efficiency of the heat transfer to the aerosol generating material 44. Each portion of aerosol generating material 44 may be provided with one of more weakened regions as appropriate.

While the above described embodiments have in some respects focused on some specific example aerosol provision systems, it will be appreciated the same principles can be applied for aerosol provision systems using other technologies. That is to say, the specific manner in which various aspects of the aerosol provision system function are not directly relevant to the principles underlying the examples described herein.

In order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention(s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein, and it will thus be appreciated that features of the dependent claims may be combined with features of the independent claims in combinations other than those explicitly set out in the claims. The disclosure may include other inventions not presently claimed, but which may be claimed in future.

The invention claimed is:

1. A method of reducing the quantity of a first constituent in aerosol generating material using an aerosol provision device configured to deliver inhalable aerosol to a user, the method comprising:

performing a first aerosolization process on a portion of the aerosol generating material comprising the first constituent to generate an aerosol for user inhalation; and performing a second aerosolization process on at least the portion of the aerosol generating material until the at least the portion of the aerosol generating material is substantially free of the first constituent;

wherein after performing the second aerosolization process on the at least the portion of the aerosol generating material until the at least the portion of the aerosol generating material is substantially free of the first constituent, the concentration of the first constituent in the at least a portion of aerosol generating material is less than 0.05 mg/ml when dissolved in 100 ml of solvent.

2. The method of claim 1, wherein the first constituent is nicotine.

3. The method of claim 1, wherein after performing a second aerosolization process on the at least the portion of the aerosol generating material until the at least the portion of the aerosol generating material is substantially free of the first constituent, the concentration of nicotine in the at least a portion of aerosol generating material is less than 0.02 mg/ml when dissolved in 100 ml of solvent.

4. The method of claim 1, wherein the aerosol generating material is an amorphous solid.

5. The method of claim 4, wherein the amorphous solid comprises 0.5-60 wt % of a gelling agent; 5-80 wt % of an aerosol generating agent; and 5-60 wt % of at least one active substance, wherein these weights are calculated on a dry weight basis.

6. The method of claim 1, wherein performing a first aerosolization process on the portion of the aerosol generating material comprising the first constituent to generate an aerosol for user inhalation comprises aerosolising the portion of the aerosol generating material for a first time period, and performing a second aerosolization process on the portion of the aerosol generating material until the portion of the aerosol generating material is substantially free of the first constituent for a second time period, wherein the second time period is greater than the first time period.

7. The method of claim 6, wherein the second time period is greater than one minute.

8. The method of claim 1, wherein the first and second aerosolization processes are performed by heating.

9. The method of claim 8, wherein heating the portion of the aerosol generating material comprising the first constituent to generate an aerosol for user inhalation comprises heating the portion of the aerosol generating material to a first maximum temperature, and heating the portion of the aerosol generating material until the portion of the aerosol generating material is substantially free of the first constituent comprises heating the portion of the aerosol generating material to a second maximum temperature, wherein the second maximum temperature is greater than the first maximum temperature.

10. The method of claim 8, wherein heating the portion of the aerosol generating material comprising the first constituent to generate an aerosol for user inhalation comprises heating the portion of the aerosol generating material to a first maximum temperature, and heating the portion of the aerosol generating material until the at least the portion of the aerosol generating material is substantially free of the first constituent comprises heating the portion of the aerosol generating material to a second maximum temperature, wherein the second maximum temperature is substantially the same as the first maximum temperature.

11. The method of claim 8, wherein the aerosol provision device comprises control circuitry configured to monitor an activation parameter for each of a plurality of portions of aerosol generating material, the activation parameter signifying one or a combination of: the number of discrete times the portion is heated; the cumulative heating time the portion is heated for; and a weighted cumulative heating time the portion is heated for based on the temperature the portion is heated to.

12. The method of claim 11, wherein the method comprises calculating a heating period for heating each of the plurality of portions of the aerosol generating material until the plurality of portions of the aerosol generating material are substantially free of the first constituent, wherein the calculation takes into account the monitored activation parameter.

13. An aerosol provision device for use with an aerosol provision article comprising aerosol generating material, wherein the aerosol generating material comprises a first constituent, the device comprising:

an aerosol generating article for performing an aerosolization process on a portion of the aerosol generating material; and control circuitry configured to activate the aerosol generating article, wherein the control circuitry is configured to:

perform a first aerosolization process on the portion of the aerosol generating material comprising the first constituent to generate an aerosol for user inhalation; and perform a second aerosolization process on the portion of the aerosol generating material until the portion is substantially free of the first constituent;

such that after performing the second aerosolization process on the at least the portion of the aerosol generating material the at least the portion of the aerosol generating material is substantially free of the first constituent, the concentration of the first constituent in the at least a portion of af the aerosol generating material is less than 0.05 mg/ml when dissolved in 100 ml of solvent.

14. The aerosol provision device of claim 13, further comprising an indicator configured to output an alert when the at least the portion of the aerosol generating material is aerosolised until the portion is substantially free of the first constituent, the alert signifying to a user not to inhale on the device.

15. The aerosol provision device of claim 13, further comprising an airflow obstructing member configured to block an air outlet on the device when the at least the portion of the aerosol generating material is aerosolised until the portion is substantially free of the first constituent.

16. An aerosol provision system comprising the aerosol provision device of claim 13.

17. The aerosol provision system of claim 16, wherein the aerosol generating article comprises a plurality of portions of aerosol generating material, wherein at least one portion comprises the first constituent.

18. A method of reducing the quantity of a first constituent in aerosol generating material using an aerosol provision device configured to deliver inhalable aerosol to a user, the method comprising:

performing a first aerosolization process on a portion of the aerosol generating material comprising the first constituent to generate an aerosol for user inhalation; and performing a second aerosolization process on at least the portion of the aerosol generating material until the at least the portion of the aerosol generating material is substantially free of the first constituent;

further comprising;

providing an alert when performing the second aerosolization process on the at least the portion of the aerosol generating material until the at least the portion of the aerosol generating material is substantially free of the first constituent, wherein the alert signifies to a user not to inhale on the device; and/or blocking an air outlet on the device when performing the first aerosolization process on the at least the portion of the aerosol generating material until the at least the portion of the aerosol generating material is substantially free of the first constituent.

* * * * *